US006801177B2

(12) United States Patent
Kudo et al.

(10) Patent No.: US 6,801,177 B2
(45) Date of Patent: Oct. 5, 2004

(54) LIQUID CRYSTAL DISPLAY DEVICE

(75) Inventors: Yasuyuki Kudo, Kamakura (JP); Tsutomu Furuhashi, Yokohama (JP); Yoshiro Mikami, Hitachiohta (JP); Shinichi Komura, Hitachi (JP); Toshio Miyazawa, Chiba (JP)

(73) Assignee: Hitachi, Ltd., Tokyo (JP)

( * ) Notice: Subject to any disclaimer, the term of this patent is extended or adjusted under 35 U.S.C. 154(b) by 212 days.

(21) Appl. No.: 09/895,065

(22) Filed: Jul. 2, 2001

(65) Prior Publication Data

US 2002/0000966 A1 Jan. 3, 2002

(30) Foreign Application Priority Data

Jul. 3, 2000 (JP) ..... 2000-205561

(51) Int. Cl.[7] ..... G09G 3/36

(52) U.S. Cl. ..... 345/89; 345/87; 345/88; 345/90; 345/91; 345/92; 345/93; 345/94; 345/95; 345/96; 345/97; 345/98; 345/99; 345/100; 345/101; 345/102

(58) Field of Search ..... 345/87–102, 89, 345/90, 91, 92, 93, 94

(56) References Cited

U.S. PATENT DOCUMENTS 5,724,057 A * 3/1998 Kimura et al. ..... 345/89
6,542,141 B1 * 4/2003 Mano et al. ..... 345/89

FOREIGN PATENT DOCUMENTS

JP 7253764 10/1995
JP 10197848 7/1998

* cited by examiner

*Primary Examiner*—Richard Hjerpe
*Assistant Examiner*—Jean Lesperance
(74) *Attorney, Agent, or Firm*—Antonelli, Terry, Stout & Kraus, LLP

(57) ABSTRACT

A liquid crystal display device includes a liquid crystal panel having a plurality of pixels disposed in a matrix format, a Y-selecting signal generating unit for selecting one or more pixel rows, an X-selecting signal generating unit for selecting one or more pixel columns, and a tone signal generating unit for generating a tone signal for applying the corresponding tone voltage to tone information of said display data onto each of the pixels.

6 Claims, 26 Drawing Sheets

| | TONE 0 | TONE 1 | TONE 2 | TONE 3 |
|---|---|---|---|---|
| VOLTAGE LEVEL OF TONE SIGNAL Dn | VB | VB+ $\beta$ | VB+2 $\beta$ | VB+3 $\beta$ |

| SIGNAL NAME | MEANING | "LOW" | "HIGH" |
|---|---|---|---|
| CS | SELECTION OF CHIP | ACCESS ENABLED | ACCESS DISABLED |
| ADS | SELECTION OF ADDRESS/DATA | ADDRESS | DATA |
| MRS | SELECTION OF MEMORY/ADDRESS | MEMORY | ADDRESS |
| E | START OF DATA WRITE/READ | NOT START | START |
| RW | SELECTION OF DATA WRITE/READ | WRITE | READ |
| DATA | 16-BIT BIDIRECTIONAL DATA | — | — |

FIG. 24
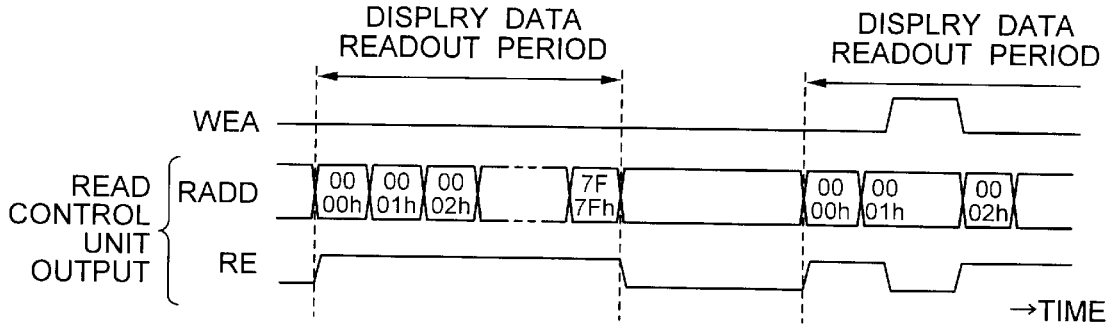
FIG. 25
| | WE_A=HIGH | WE_A=LOW |
|---|---|---|
| MADD | WADD | RADD |
| MDATA | WDATA | RDATA (MEMORY OUTPUT) |
| MRE | RE | RE |
| MWE | WE_A | WE_A |
| DISPLAY DATA | WDATA | RDATA |
| ADDRESS | WADD | RADD |
| ENABLE | WE_A | RE |
FIG. 26
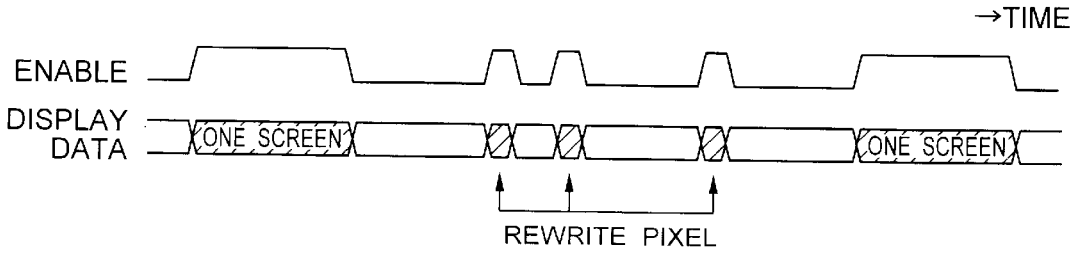

| TONE NUMBER IS 8 | | TONE NUMBER IS 16 | |
|---|---|---|---|
| TONE DATA | VOLTAGE APPLYING TIME | TONE DATA | VOLTAGE APPLYING TIME |
| 0 | (0/49)T | 0 | (0/225)T |
| 1 | (1/49)T | 1 | (1/225)T |
| 2 | (4/49)T | 2 | (4/225)T |
| 3 | (9/49)T | 3 | (9/225)T |
| ⋮ | ⋮ | ⋮ | ⋮ |
| 7 | (49/49)T | 15 | (225/225)T |

LIQUID CRYSTAL DISPLAY DEVICE

BACKGROUND OF THE INVENTION

The present invention relates to a liquid crystal display device which is arranged to display data, and more particularly to the liquid crystal display device which includes pixels disposed in a matrix format.

As the prior arts, the JP-A-9-258168 and the JP-A-11-2797 disclose the liquid crystal display device which includes memory means for holding data on each pixel and switching means for controlling a switching operation according to the data held in the memory means so that an ac waveform may be applied onto the opposed electrode.

For example, in the case of displaying a still picture, these prior arts do not need to enter data during the time when the memory means holds the data and to change a voltage to be applied onto scan lines and data lines. On the other hands, these prior arts implement alternating in asynchronous to the input of the data to be displayed.

These prior arts, however, have a disadvantage that the wires for the display data to be connected with pixels are increased in number as the amount of tone information contained in the display data is increased, resulting in making the overall circuit complicated. For example, if the display data includes 2-tone ($2^1$) data per one pixel, only one wire is required for one pixel, while if the display data includes 64-tone ($2^6$) data, the number of wires required for one pixel is as many as six.

SUMMARY OF THE INVENTION

It is an object of the present invention to provide a liquid crystal display device which enables to display data having a great amount of tone information and may have a simplified circuit arrangement.

It is a further object of the present invention to provide a liquid crystal display device which is arranged to suppress power consumption.

According to an aspect of the invention, the liquid crystal display device includes a liquid crystal panel having a plurality of pixels disposed in a matrix format, a Y-selecting signal generating unit for selecting rows of the pixels, an X-selecting signal generating unit for selecting columns of the pixels, and a tone signal generating unit for generating a tone signal for applying a tone voltage corresponding to the tone information of the display data to each of the pixels.

According to another aspect of the invention, the liquid crystal display device includes a liquid crystal panel having a plurality of pixels disposed in a matrix format, a Y-selecting signal generating unit for selecting rows of the pixels, and a tone signal generating unit for generating a tone signal corresponding to the tone information of the display data, for the pixels specified by the Y-selecting signal sent from the Y-selecting signal generating unit and then supplying the tone signal to the specified pixels. More preferably, the liquid crystal display device is arranged to generate a tone signal corresponding to the tone information of the display data, for each of the pixels disposed on the liquid crystal panel and applying a tone voltage corresponding to the tone signal to the pixels selected by at least one of the Y-selecting signal for selecting the rows of the pixels and the X-selecting signal for selecting the columns of the pixels.

According to another aspect of the invention, the liquid crystal display device includes a pair of substrates at least one of which is transparent, a liquid crystal layer formed between the pair of substrates, a liquid crystal panel having a plurality of pixels disposed in a matrix format and serving to change a transmissivity of the liquid crystal layer, a Y-selecting signal generating unit for selecting rows of the pixels, an X-selecting signal generating unit for selecting columns of the pixels, a tone signal generating unit for generating a tone signal corresponding to tone information of the display data and supplying the tone signal to each of the pixels, a memory circuit for starting to hold the tone signal sent from the tone signal generating unit if the Y-selecting signal sent from the Y-selecting signal generating unit and the X-selecting signal sent from the X-selecting signal generating unit are changed from a non-selecting state into a selecting state, a pulse width modulating circuit for modulating the tone signal sent from the memory circuit in time, for generating a binary pulse width signal, a switching circuit for switching an ac signal into a sensor voltage signal or vice versa according to the level of the binary pulse width signal, and a pixel electrode connected to the switching circuit. More preferably, the liquid crystal display device is arranged to generate the tone signal corresponding to the tone information of the display data, for each of the pixels disposed on the liquid crystal panel, hold the tone signal in the memory circuit provided for each of the pixels if any pixel located on the liquid crystal panel is changed from the non-selecting state into the selecting state, modulate the tone signal sent from the memory circuit in time, for generating a binary pulse width signal, and switch the ac signal into a center voltage signal or vice versa according to the level of the binary pulse width signal and supply the signal into the pixel electrode.

According to another aspect of the invention, the liquid crystal display device includes a liquid crystal panel having a plurality of pixels disposed in a matrix format, a holding circuit provided for each of the pixels and for holding a tone voltage corresponding to the tone information of the display data, a refresh circuit for refreshing the tone voltage held in the holding circuit, and a rewriting circuit for rewriting the tone voltage held in the holding circuit according to the tone information. More preferably, the liquid crystal display device is arranged to hold the tone voltage corresponding to the tone information of the display data in the holding circuit provided for each of the pixels located on the liquid crystal panel, display the data by applying the held tone voltage onto each of the pixels, and select the refresh or the rewrite of the holding circuit according to the tone information.

BRIEF DESCRIPTION OF THE DRAWINGS

FIG. 24 is a timing chart showing an operation of a read control unit according to the first embodiment of the present invention;

FIG. 25 is a table showing an operation of a memory control unit according to the first embodiment of the present invention;

FIG. 26 is a timing chart showing an output signal of a liquid crystal controller according to the first embodiment of the present invention;

DETAILED DESCRIPTION OF THE EMBODIMENTS

Figure 2:
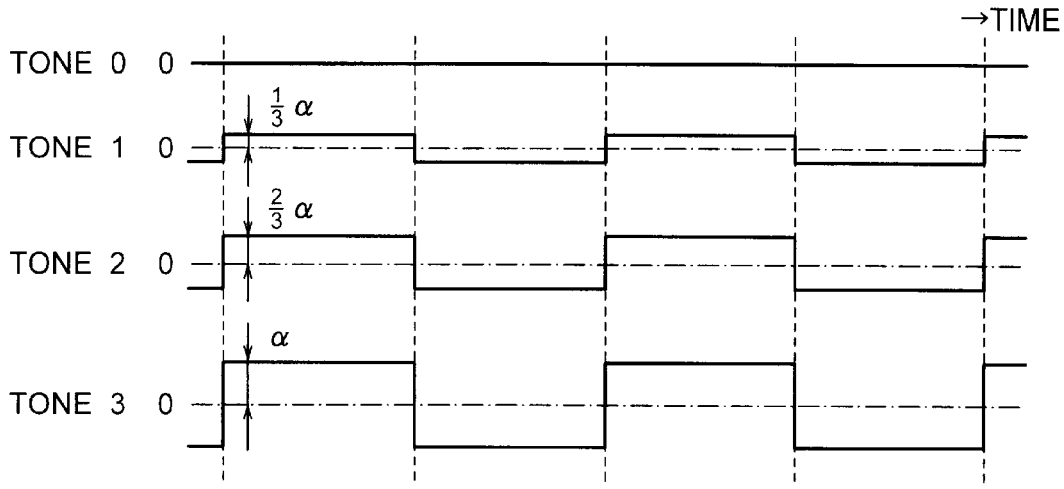
FIG. 2 is a timing chart showing a voltage waveform to be applied onto liquid crystal according to the first embodiment of the present invention.

The embodiment of the present invention is arranged to apply one selecting signal for indicating a selected line (row) on each scan line (Y-selecting signal line) in a time-divisional manner and apply a tone signal at the corresponding level to the tone information contained in the display data on the selected line onto an overall one data line (tone signal line) in synchronous to the selecting voltage. By this operation, the switching element for each of the pixels on the scan line where the selecting signal is applied is temporarily turned on while the selecting signal is being applied, when the tone signal from the data line is applied onto the pixel capacitance. By this operation, a voltage difference takes place between the pixel electrode and the opposed electrode and the voltage difference is again held until the selecting signal is applied during the next frame period. This operation allows the matrix type liquid crystal display device whose light transmissivity (simply referred to as display luminance) is changed by the effective value of the applied voltage to individually control the display luminance of each pixel. In this driving system, for the purpose of preventing the liquid crystal from being degraded, the tone signal to be applied in the next frame period is kept reversed with a certain reference voltage as a center. The reversing of polarity for each frame is simply referred to as alternating. Further, an example of the voltage applied onto the liquid crystal for displaying four tones through the use of the liquid crystal display device is illustrated in FIG. 2.

For the purpose of reducing the number of wires to be connected to the pixels, it is preferable to convert the tone information into a multilevel tone signal and input the tone signal into each pixel. This allows the multilevel tone information to be inputted through only one wire. Moreover, the memory circuit for holding this tone signal is provided inside the pixel. This makes it possible to reduce the number of wires to be connected with the pixels. While the memory circuit is holding the display data (tone signal), it is not necessary to input a signal from the outside and apply a voltage onto the scan line and the data line.

Then, for converting the held tone signal into an ac voltage to be applied to the liquid crystal, it is converted into a pulse voltage. This allows the effective value of the voltage applied onto the liquid crystal to be controlled on the binary voltage level (ternary level if an ac voltage is included), which makes it possible to simplify the circuit. For example, the voltage waveform to be applied on the liquid crystal for each tone as shown in FIG. 2 is equivalent to the ac pulse waveform shown in FIG. 3 in respect of the voltage effective value. Hence, for the liquid crystal whose display luminance is changed on the effective value of the applied voltage, the liquid crystal may offer the same display luminance even if any one of these two waveforms may be applied to the liquid crystal.

Figure 3:
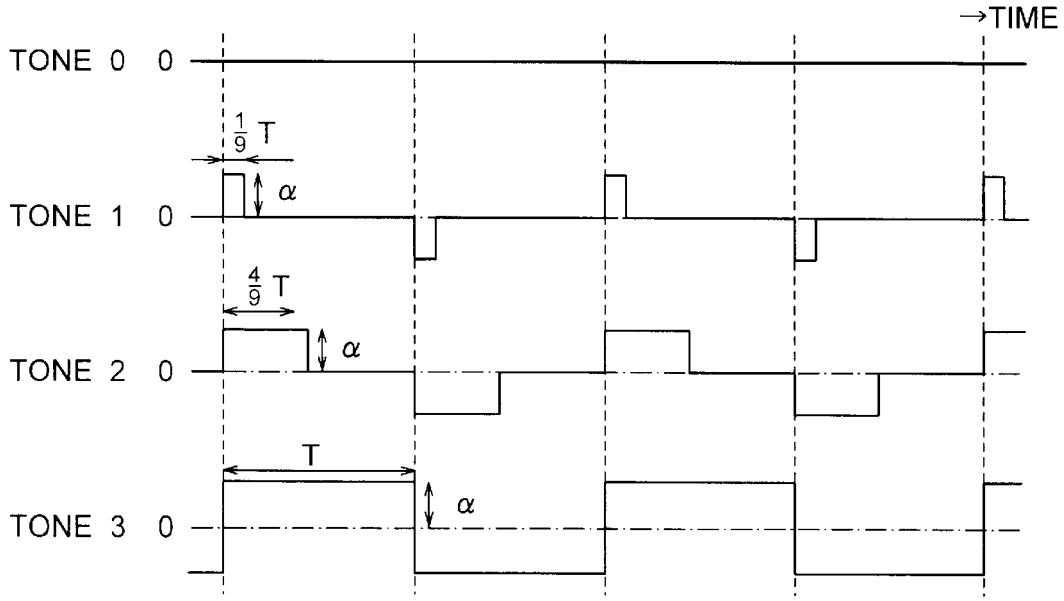
FIG. 3 is a timing chart showing a voltage waveform to be applied onto liquid crystal according to the first embodiment of the present invention.
Figure 4:
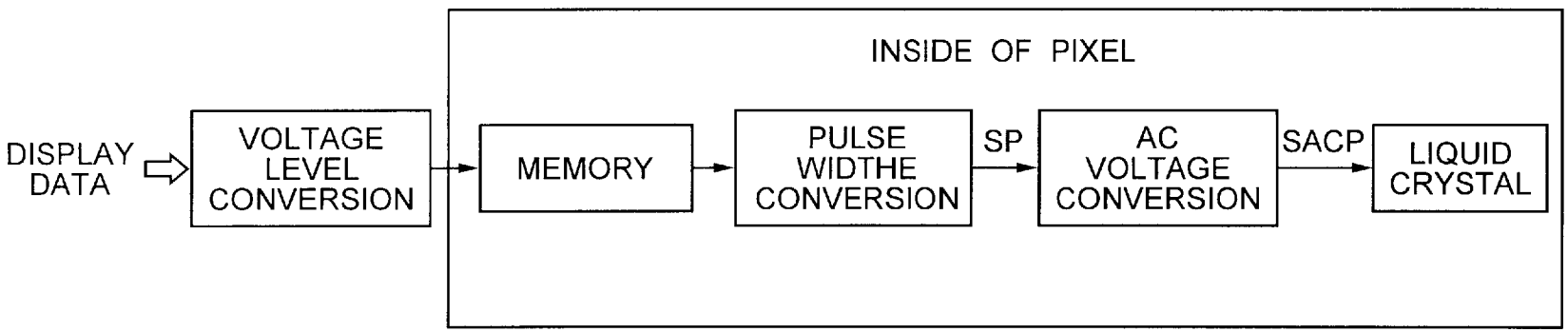
FIG. 4 is a block diagram showing a structure of a pixel according to the first embodiment of the present invention.
Figure 5:
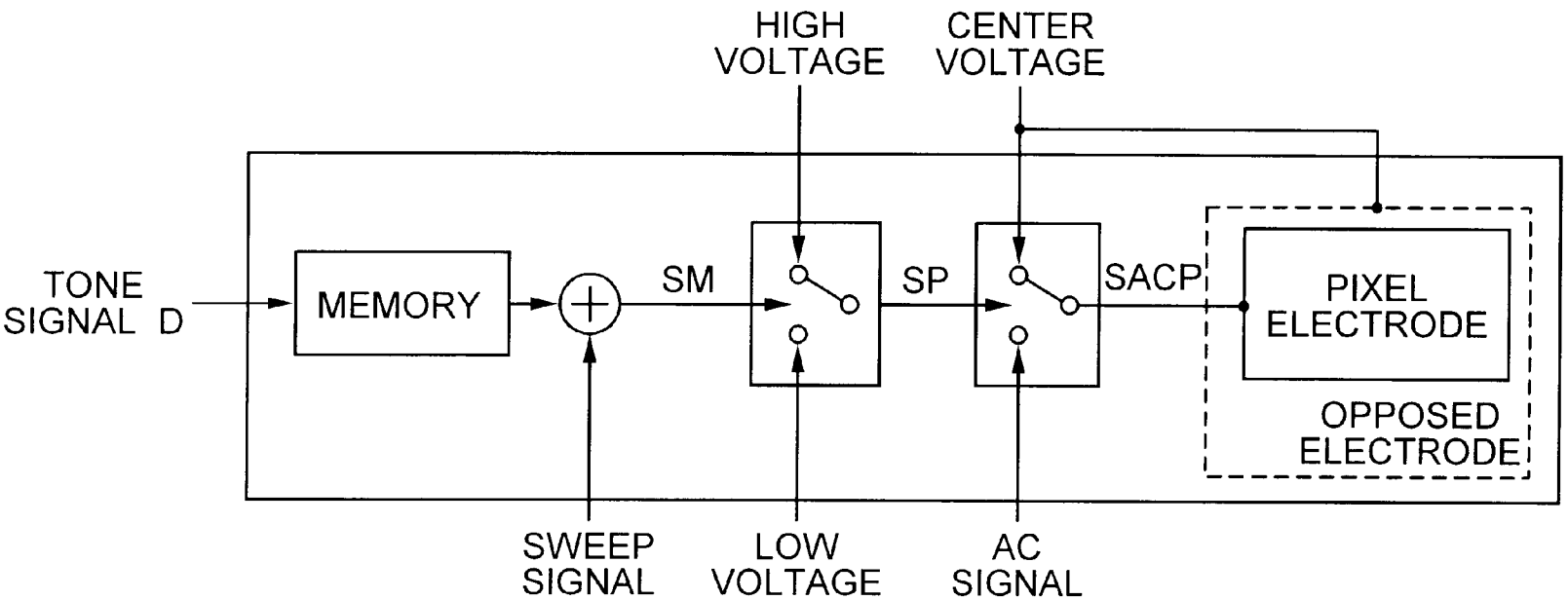
FIG. 5 is a block diagram showing a structure of a pixel according to the first embodiment of the present invention.

Under these conditions, as shown in FIG. 4, the liquid crystal display device according to the invention provides a converting circuit for converting the tone information included in the display data into a tone signal D, which circuit serves to input this tone signal D into each pixel. Inside the pixel, there are provided a memory circuit for holding the tone signal D, a converting circuit for converting the held tone signal D into a binary pulse signal SP, and a generating circuit for generating an ac pulse signal SACP on the basis of the "high" or the "low" level of the binary pulse signal SP so that the ac pulse signal SACP may be applied to the liquid crystal. More specifically, as shown in FIG. 5, the voltage level of the sweep signal is added to the voltage level of the tone signal D held in the memory circuit and then the added signal is supplied as the memory signal SM to the next switch circuit so that the signal SM serves to control the switch circuit at the next stage. This operation allows the switch circuit to control the time width of a pulse when the "high" and the "low" signals are outputted through the level of the tone signal D. Further, the pulse signal SP outputted from this switch circuit is made to be the control signal of the switch circuit at the next stage. This allows the time width when the switch circuit outputs the ac signal or the center voltage to be controlled on the pulse signal SP. The foregoing operation makes it possible for the tone signal D held inside of the pixel to be converted into the ac pulse waveform shown in FIG. 3.

In the liquid crystal display device according to the invention, only one wire for transmitting this information is needed if the amount of tone information included in the display data is increased. Further, the inside of the pixel is composed of one memory circuit and two switch circuits.

Hereafter, the first embodiment of the present invention will be described with reference to FIG. 1 and FIGS. 6 to 27.

Figure 1:
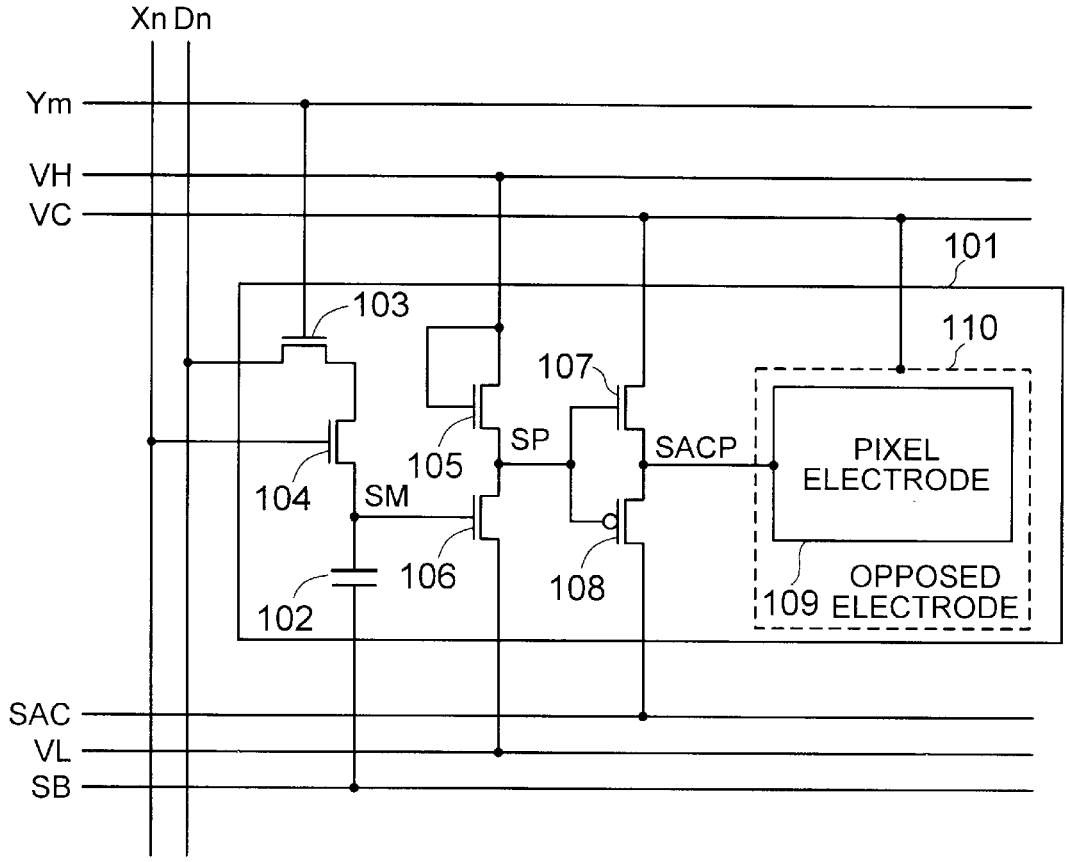
FIG. 1 is a circuit diagram showing a structure of a pixel according to a first embodiment of the present invention.

FIG. 1 shows a composition of a pixel of mth row and nth column in the matrix type liquid crystal display device according to the first embodiment of the invention. A numeral 101 denotes a pixel which is composed of one capacitor 102, five N type MOS transistors 103 to 107, one P type MOS transistor 108, a pixel electrode 109, and an opposed electrode 110 located on the opposite side to the pixel electrode 109 with a liquid crystal layer laid therebetween. The signals to be inputted to the pixels are a Y-selecting signal Ym, an X-selecting signal Xn, a tone signal Dn, a sweep signal SB, and an ac signal SAC. The voltages to be inputted to the pixels are a high voltage VH, a low voltage VL, a center voltage VC. The circuit shown in FIG. 1 holds true to the connections of these signals.

Figure 6:
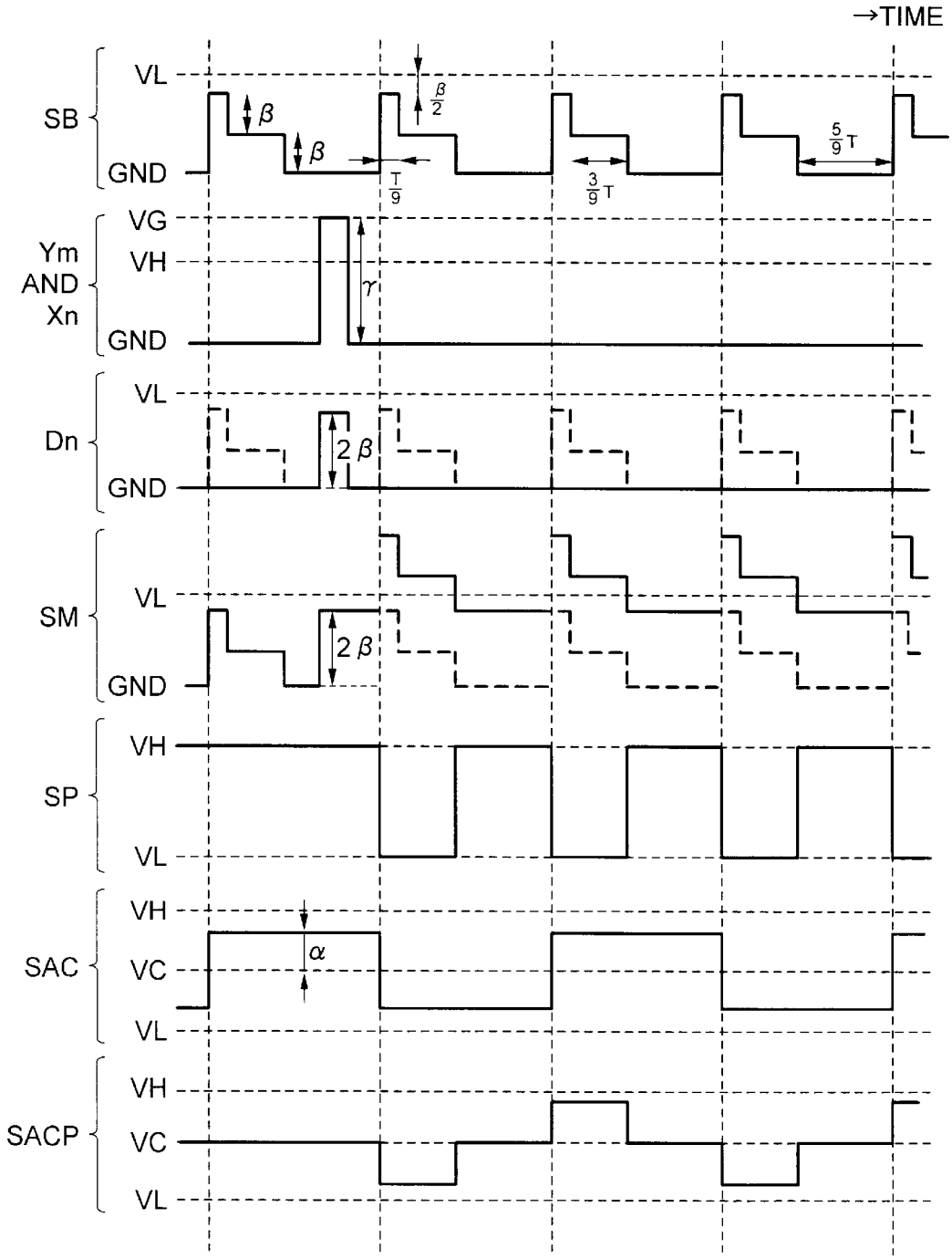
FIG. 6 is a timing chart showing an operation of a pixel according to the first embodiment of the present invention.
Figures 7, 8:
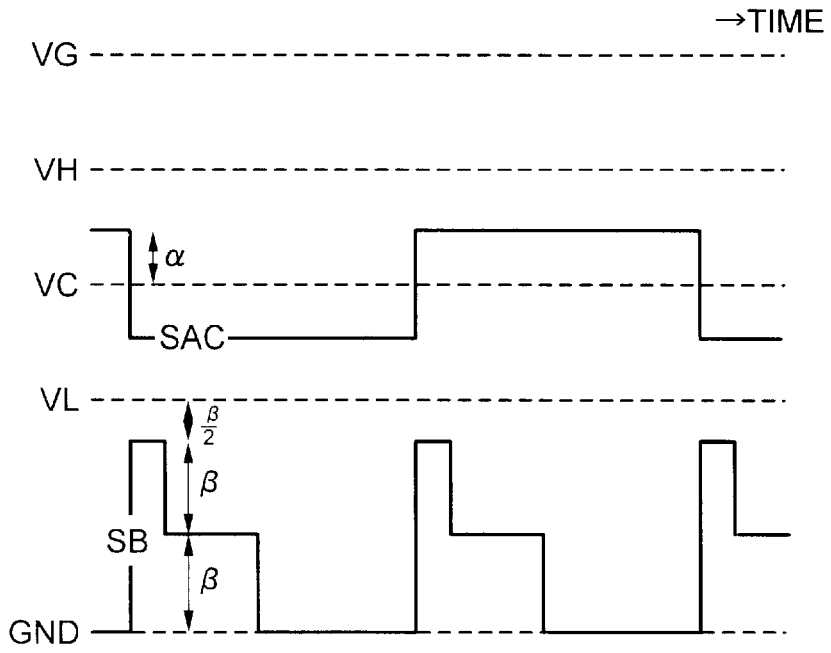
FIG. 7 is a table showing relation between display data and tone signals according to the first embodiment of the present invention.
FIG. 8 is a chart showing potential relation of an input signal of the pixel according to the first embodiment of the present invention.

Then, with the case of generating the tone 2 voltage waveform to be applied onto the liquid crystal as shown in FIG. 3 as an example, the operation of the pixel 101 will be described with reference to FIGS. 6 to 8. FIG. 6 is a timing chart of a group of the signals to be inputted into the pixels. At first, the sweep signal SB is a stepwise waveform synchronized with the alternating period T, in which waveform the starting (T/9) time transitions to 2β, the next (3T/9) time transitions to β, and the last (5T/9) time transitions to the GND (ground) level. Herein, the voltage 2β is lower than the low voltage VL by (β/2).

Next, the Y-selecting signal Ym is normally positioned at the GND level. The signal Ym takes a so-called pulse waveform in which it transitions to the selection on voltage VG with a peak value γ on the timing when the tone information is written to the pixel. Likewise, the X-selecting signal Xn is normally positioned at the GND level. The signal Xn is changed into the selection on voltage VG with a peak value γ on the timing when the tone information is written into the pixel. The selection on voltage VG is higher than the high voltage VH.

Next, the tone signal Dn is normally positioned at the GND level. The signal Dn is changed into the voltage level at which the voltage for the tone information is added to the voltage of the sweep signal SB. The relation between the tone information and the voltage level to be added thereto is as shown in FIG. 7. The tone signal to be applied onto the Dn line is a result of converting the tone information represented by the display data having the tone information composed of bits to be transferred from the system bus through the use of the instruction of the MPU on the basis of the relation shown in FIG. 7. In addition, the present description will be expanded on the example that the tone 2 is displayed. Since the voltage level of the sweep signal SB is positioned at the GND level on the timing where the tone information is written into the pixel, the voltage level of the tone signal Dn at this time is made to be 2β.

When these voltages are inputted into the pixel 101, on the timing when the Y-selecting signal Ym and the X-selecting signal Xn are changed into the selection on voltage VG, the N type MOS transistors 103 and 104 are turned on. At a time, the tone signal Dn is written into the capacitor 102 so that the potential difference of 2β is held between the sweep signal SB and the memory signal SM. This operation allows the memory signal SM to have a stepwise waveform with a higher voltage than the sweep signal SB by 2β.

The memory signal SM is served to control the operation of the N type MOS transistors 105 and 106. If the voltage level is VL or higher, the N type MOS transistor 106 is turned on and the pulse signal SP is made to a low voltage VL, while if the voltage level is VL or lower, the N type MOS transistor 106 is turned off and the pulse signal SP is made to be a high voltage VH. In the example shown in FIG. 6, the pulse signal SP is made to be the low voltage VL during the first (4T/9) time from the next period after the tone information is written into the pixel or the high voltage VH during the remaining (5T/9) time. This transition is repeated.

The pulse signal SP is a signal for controlling the operation of a select switch circuit composed of the N type MOS transistor 107 and the P type transistor 108. When the voltage level is low, the N type MOS transistor 107 is turned off, the P type MOS transistor 108 is turned on, and the ac pulse signal SACP is made to be the ac signal SAC. Conversely, when the pulse signal SP is high, the N type MOS transistor 107 is turned on, the P type MOS transistor 108 is turned off, and the ac pulse signal SACP is made to be the center voltage VC. In the example shown in FIG. 6, the ac pulse signal SACP is made to be the ac signal SAC during the first (4T/9) time from the next period after the tone information is written into the pixel and then to the center voltage VC during the remaining (5T/9) time. This transition is repeated. In addition, the center voltage VC is positioned at a middle level between the high voltage VH and the low voltage VL. Further, the voltage swing of the ac signal SAC ranges between ±α with the center voltage VC as the center. It is in the range between the high voltage VH and the low voltage.

Since the voltage level to be applied onto the opposed electrode 110 is the center voltage VC, the voltage waveform to be applied to the liquid crystal is made to be the ac pulse waveform with the voltage difference between the ac pulse signal SACP and the center voltage VC, that is, 0V as its center. It is to be understood that this pulse waveform is the same as the tone 2 voltage waveform to be applied to the liquid crystal shown in FIG. 3.

In addition, the voltage level of each input signal will be described in the foregoing description about the operation. The relation among those signal voltage levels is summarized in FIG. 8.

Figure 9:
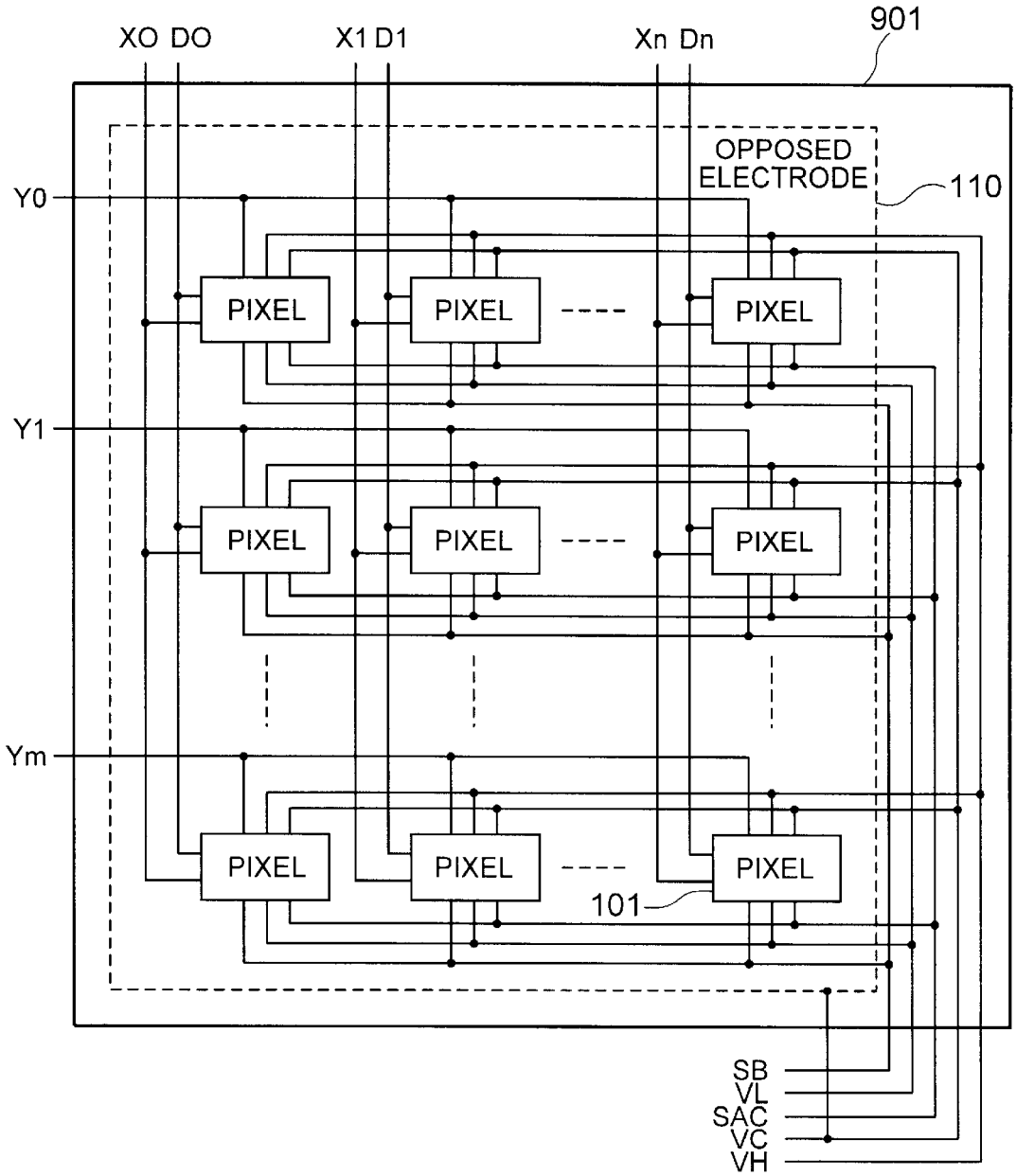
FIG. 9 is a circuit diagram showing display information of a group of pixels according to the first embodiment of the present invention.
Figure 10:
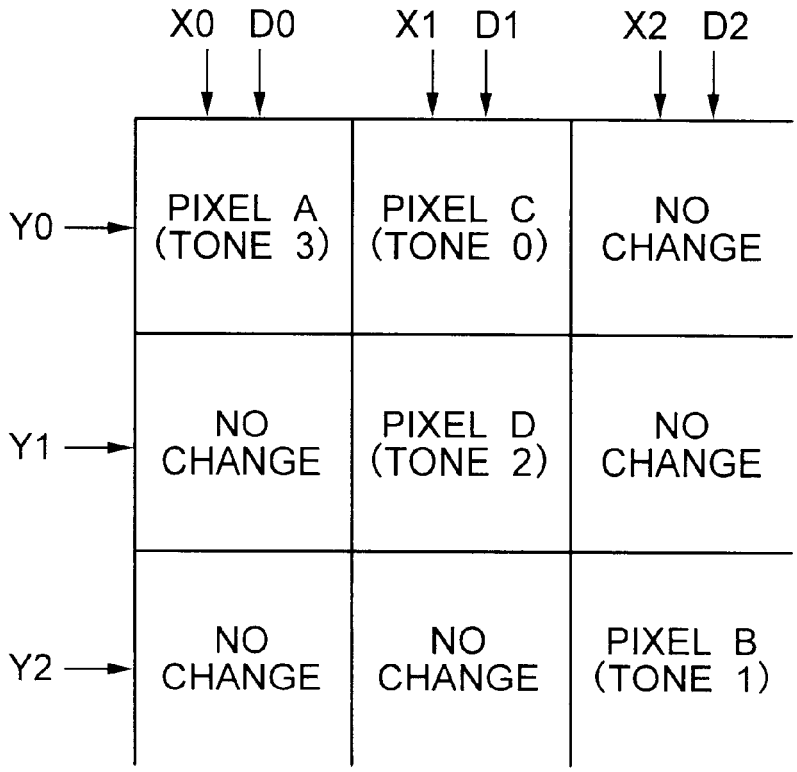
FIG. 10 is a view showing display information of the group of pixels according to the first embodiment of the present invention.
Figure 11:
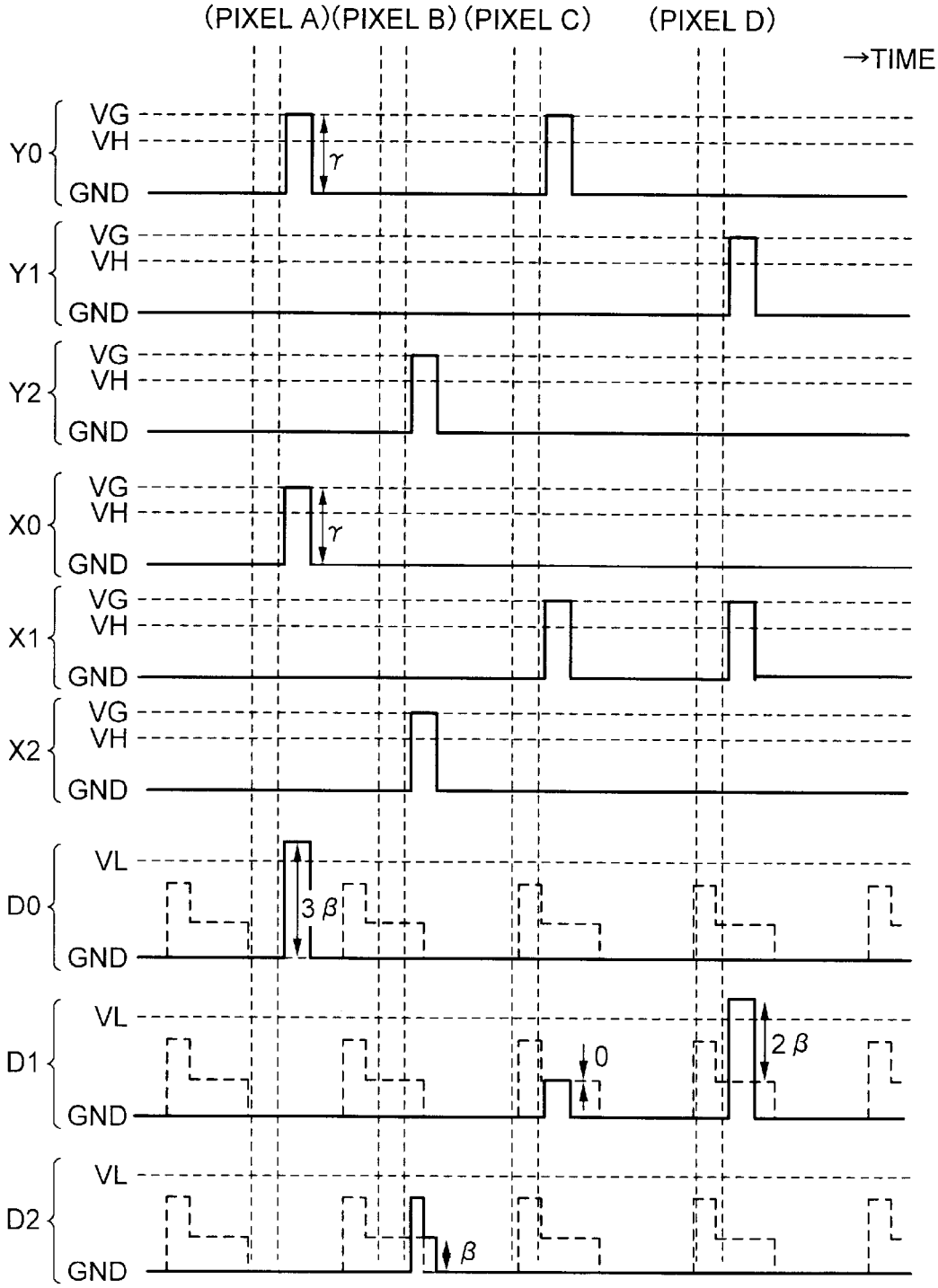
FIG. 11 is a timing chart of an input signal of the group of pixels according to the first embodiment of the present invention.

In turn, the description will be oriented to the operation of providing each of the pixels 101 located in the matrix format with the display luminance corresponding to the display data with reference to FIGS. 9 to 11. FIG. 9 shows the connection of the group of input signals to the group of pixels 901 formed by the pixels 101 arranged in the matrix format. In FIG. 9, the Y-selecting signal is inputted as a common signal into the horizontal pixels, while the X-selecting signal and the tone signal D are inputted as a common signal into the vertical pixels. The other input signals, that is, the sweep signal SB, the ac signal SAC and the input voltages, that is, the high voltage VH, the low voltage VL and the center voltage VC are common to all the pixels. The inside composition of each pixel is the same as that of the pixel 101 as shown in the above drawings. The opposed electrode 110 is common to all the pixels to which the center voltage VC is inputted.

As shown in FIG. 10, the description will be oriented to the operation of sequentially providing the following four pixels with the display luminance in a portion of the pixel group 901 (where the Y-selecting signals Y0 to Y2 and the X-selecting signals X0 to X2 are inputted).

Pixel A: An intersection between the Y-selecting signal Y0 and the X-selecting signal X0 (tone 3)

Pixel B: An intersection between the Y-selecting signal Y2 and the X-selecting signal X2 (tone 1)

Pixel C: An intersection between the Y-selecting signal Y0 and the X-selecting signal X1 (tone 0)

Pixel D: An intersection between the Y-selecting signal Y1 and the X-selecting signal X1 (tone 2)

FIG. 11 is a timing chart of the Y-selecting signals Y0 to Y2, the X-selecting signals X0 to X2, and the tone signals D0 to D2. In FIG. 11, for selecting the pixel A, the Y-selecting signal Y0 and the X-selecting signal X0 are changed into the selection on voltage VG, on the timing when the tone signal D0 is changed into the higher voltage level than the sweep signal shown in a dotted line by 3β. Then, for selecting the pixel B, Y2 and X2 are changed into the selection on voltage VG, on the timing when D2 is changed into a higher voltage than the sweep signal SB by β. Likewise, for selecting the pixel C, Y0 and X1 are changed into the selection on voltage VG, on the timing when D1 is changed into the same voltage level as the sweep signal SB. Lastly, for selecting the pixel D, Y1 and X1 are changed into the selection on voltage VG, on the timing when D1 is changed into a higher voltage level than the sweep signal SB by 2β.

The foregoing operation makes it possible to write the signal level corresponding to the desired tone information on the pixels A to D individually and thereby convert the ac pulse signal SACP of the time width corresponding to the tone information described above. This therefore allows the target pixel included in the pixel group 901 to be provided with the desired display luminance.

Figure 12:
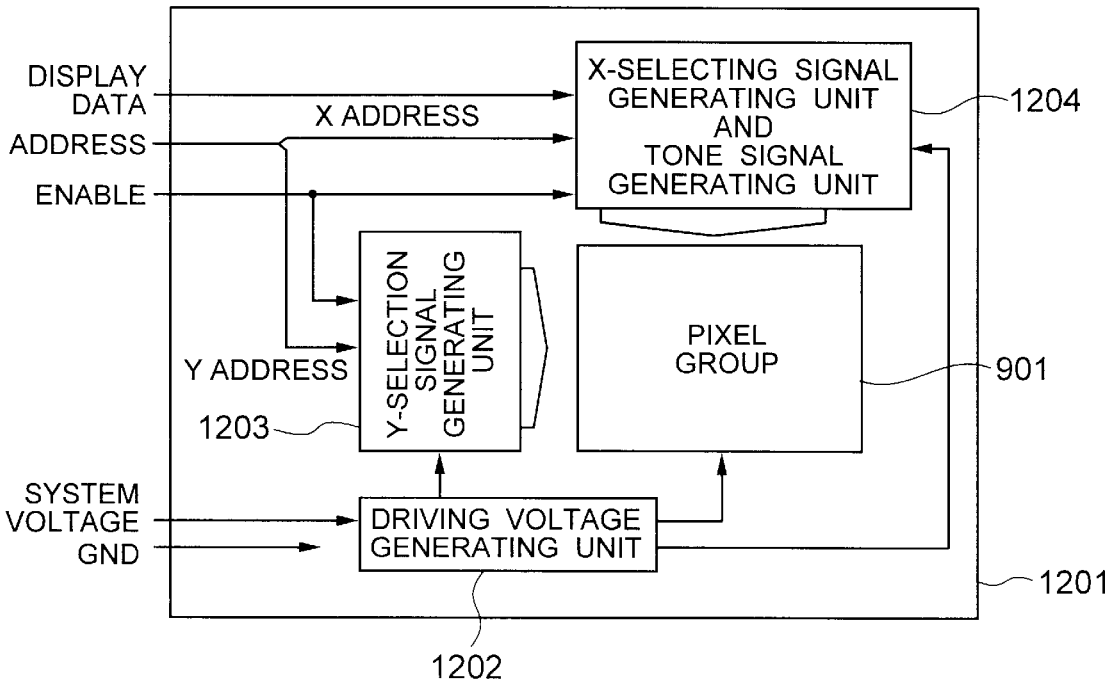
FIG. 12 is a block diagram showing an arrangement of a liquid crystal module according to the first embodiment of the present invention.

In turn, the description will be oriented to the arrangement and the operation of the liquid crystal module included in the driving circuit for generating a group of input signals with reference to FIGS. 12 to 20. FIG. 12 is a block diagram showing an arrangement of a liquid crystal module 1201, in which a numeral 1202 denotes a driving voltage generating unit, a numeral 1203 denotes a Y-selecting signal generating unit, a numeral 1204 denotes an X-selecting signal generating unit and tone signal generating unit. The signal group to be inputted to the liquid crystal module 1201 includes display data, an address, an enable, a system voltage, and a GND.

Figure 13:
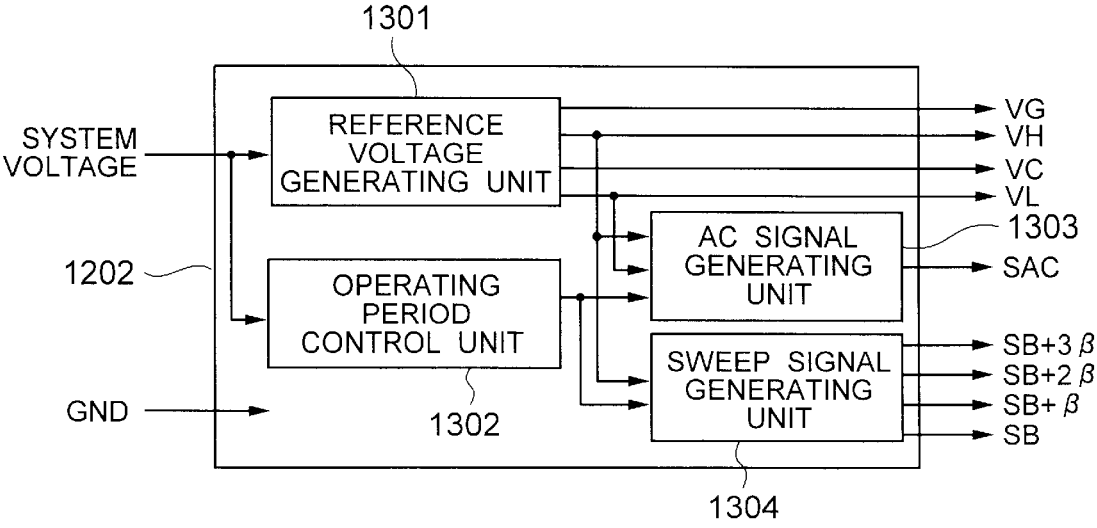
FIG. 13 is a block diagram showing an arrangement of a driving voltage generating unit according to the first embodiment of the present invention.
Figure 14:
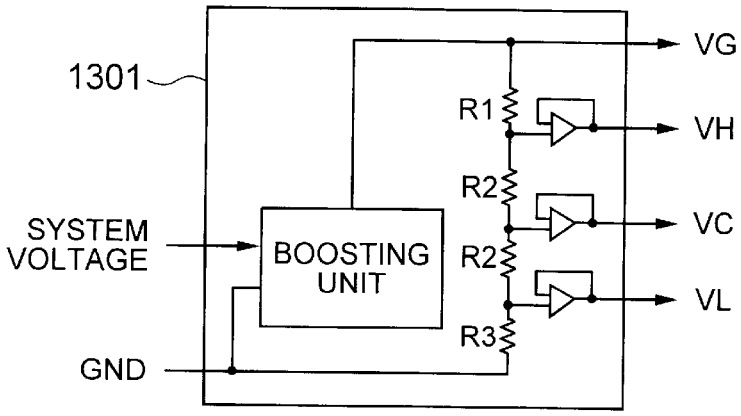
FIG. 14 is a block diagram showing an arrangement of a reference voltage generating unit according to the first embodiment of the present invention.
Figure 15:
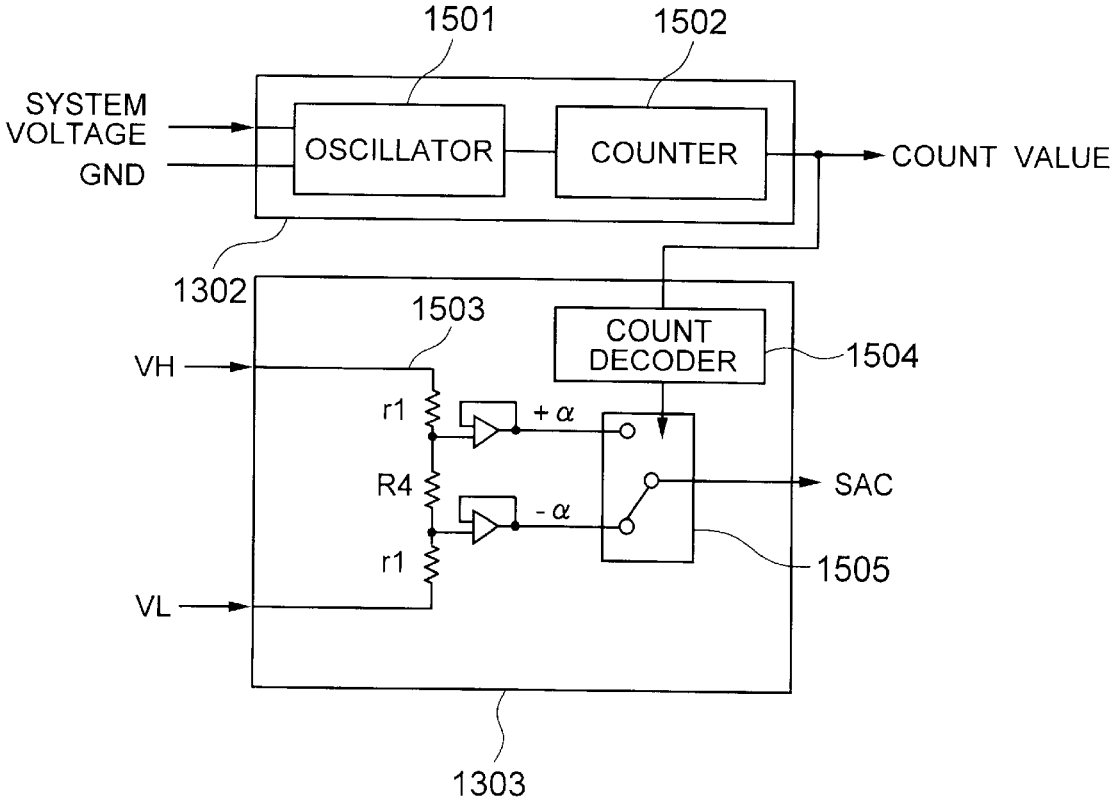
FIG. 15 is a block diagram showing arrangements of an operating period control unit and an ac signal generating unit according to the first embodiment of the present invention.
Figure 16:
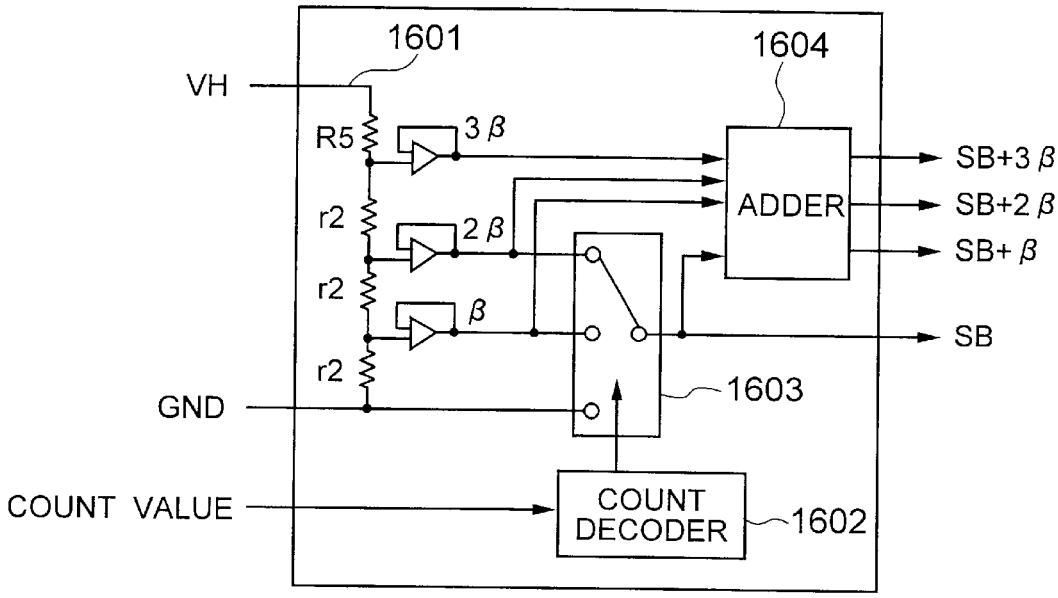
FIG. 16 is a block diagram showing an arrangement of a sweep signal generating unit according to the first embodiment of the present invention.

At first, the arrangement and the operation of the driving voltage generating unit 1202 will be described below. FIG. 13 is a block diagram showing an arrangement of a driving voltage generating unit 1202 composed of a reference voltage generating unit 1301, an operating period controlling unit 1302, an ac signal generating unit 1303, and a sweep signal generating unit 1304. The reference voltage generating unit 1301 is a block for generating a selection on voltage VG, a high voltage VH, a center VC, and a low voltage VL. The block 1301 serves to generate each reference voltage so as to keep the relation of the voltage levels shown in FIG. 8. For example, as shown in FIG. 14, this makes it possible to raise the system voltage and generate the selection on voltage VG, and further generate the other voltage levels by dividing the selection on voltage VG and the GND level through the use of the resistance. Then, as shown in FIG. 15, the operating period generating unit 1302 is composed of an oscillator 1501 and a counter 1502 for counting a clock signal outputted by an oscillator. Herein, the period of the clock signal outputted from the oscillator 1502 is (1/9) of an ac period T. The counter 1502 is a 18-digit counter for iteratively counting 0 to 17. As shown in FIG. 15, the ac signal generating unit 1303 is composed of a voltage divider 1503, a count decoder 1504, and a switch 1505 for selecting an output of the voltage divider 1503 on the output of the count decoder. The voltage divider 1503 divides the signal into the high voltage VH and the low voltage VL and outputs the voltage level ranging between +α and −α that is a voltage amplitude of the ac signal SAC. The count decoder 1504 decodes the output of the counter 1502 and then outputs the control signal for the switch 1505. More specifically, if the count value is 0 to 8, a value of "0" is outputted and if the count value is 9 to 17, a value of "1" is outputted. The switch 1505 selects the voltage value −α if the control signal is "0" or the voltage value +α if the control signal is "1" and outputs it as the ac signal SAC. The foregoing operation allows the ac signal SAC to have such a signal waveform as changing the voltage level into +α or −α at each period T shown in FIG. 6. Then, as shown in FIG. 16, the sweep signal generating unit 1304 is composed of a voltage divider circuit 1601, a count decoder 1602, a switch 1603, and an adder 1604. The voltage divider circuit 1601 serves to divide the signal into the high voltage VH and the GND and then output the voltage levels of β, 2β and 3β that are used for creating the sweep signal SB. The count decoder 1602 serves to decode the output of the counter 1502 and then output the control signal for the switch 1603. More specifically, a value of "0" is outputted if the count value is 0 or 9, a value of "1" is outputted if the count value is 1 to 3 or 10 to 12, and a value of "2" is outputted if the count value is 4 to 8 or 13 to 17. The switch 1505 selects 2β if the control signal is "0", β if the control signal is "1", or a GND voltage if the control signal is "2" and then outputs the selected signal as the sweep signal SB. The foregoing operation allows the sweep signal SB to have such a signal waveform as transitioning to 2β in the first (T/9) time in the period T, β in the second (3T/9) time, or the GND level in the last (5T/9) time as shown in FIG. 6. Further, the adder 1604 serves to add the voltage levels of β, 2β and 3β to the sweep signal SB and then output the added results as SB+β, SB+2β, and SB+3β. These signals are used as a signal for generating the tone signal D.

Figure 17:
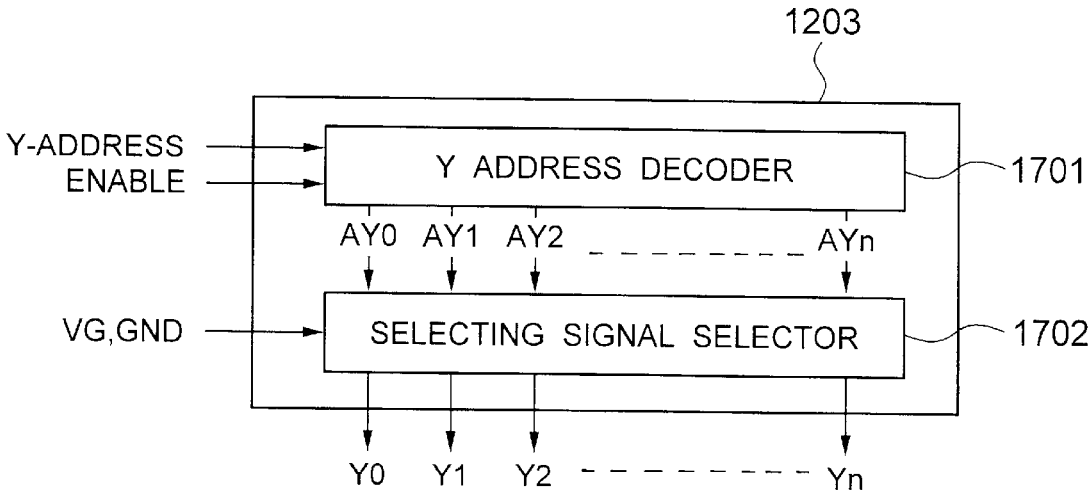
FIG. 17 is a block diagram showing an arrangement of a Y-selecting signal generating unit according to the first embodiment of the present invention.
Figure 19:
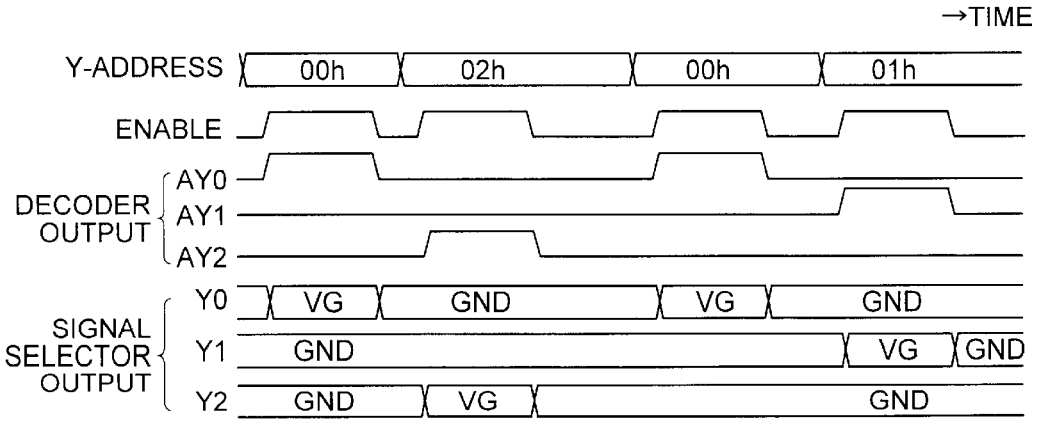
FIG. 19 is a timing chart showing an operation of the Y-selecting signal generating unit according to the first embodiment of the present invention.

Next, the description will be oriented to the arrangement of the operation of the Y-selecting signal generating unit 1203. As shown in FIG. 17, the Y-selecting signal generating unit 1203 is composed of a Y address decoder 1701 and a selection signal selector 1702, in which the input signals are a Y address and an enable and the input voltages are a selection on voltage VG and the GND. As shown in FIG. 19, the Y address decoder 1701 outputs an AY signal that the line specified by the Y address signal is "high" when the enable signal is "high". The selection signal selector 1702 serves to change the voltage level of the line where the "high" AY signal is outputted into the selection on voltage VG and change the voltage level of the other lines into the GND and then output the result as the Y-selecting signal. FIG. 19 shows the inputs of the Y address and the enable for realizing the operation of the Y-selecting signals Y0 to Y2 that has been shown in FIG. 11. The Y addresses 00h, 01h and 02h indicate the addresses for selecting the Y-selecting signals Y0, Y1 and Y2, respectively.

Figure 18:
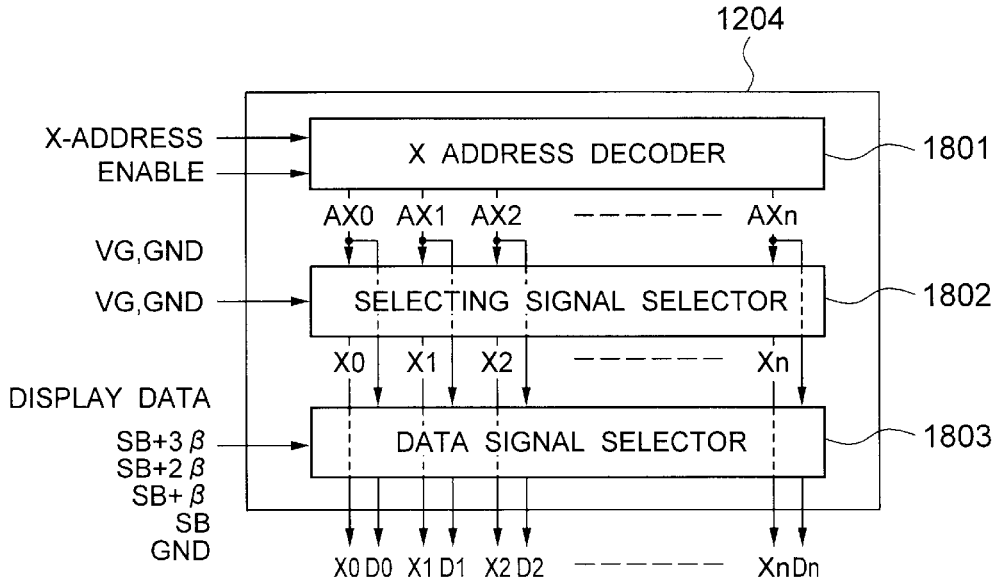
FIG. 18 is a block diagram showing an arrangement of an X-selecting signal generating unit and a tone signal generating unit according to the first embodiment of the present invention.
Figure 20:
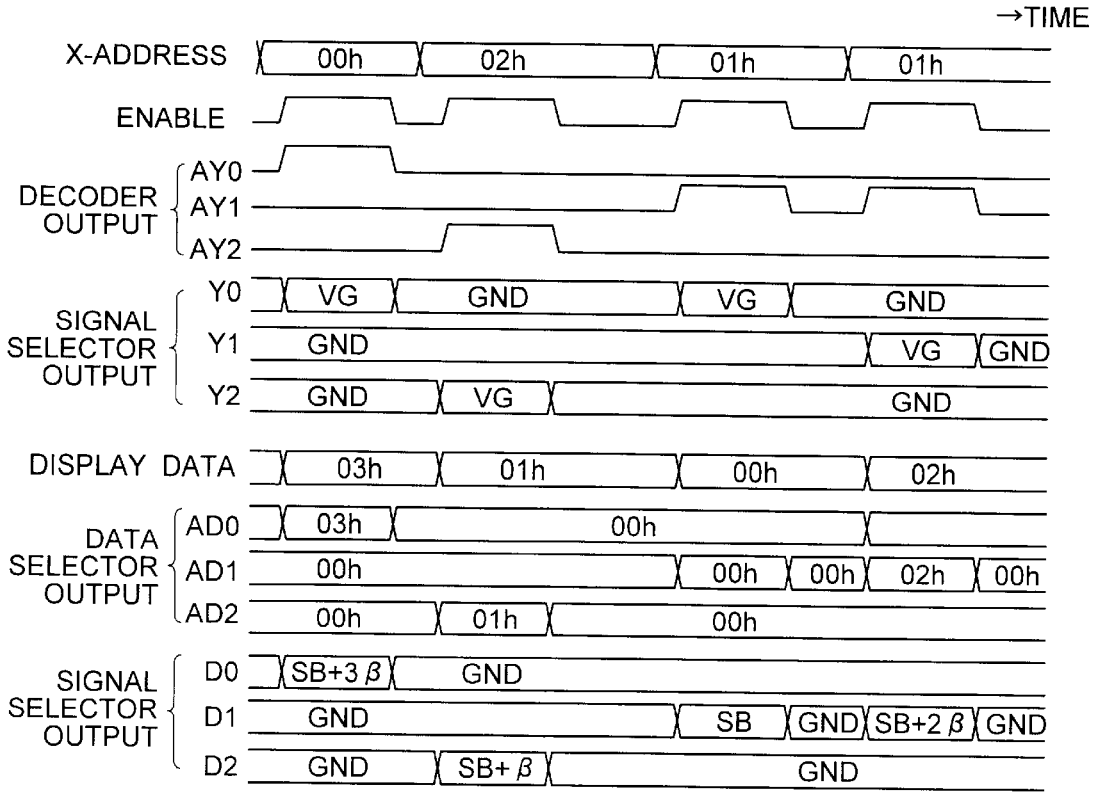
FIG. 20 is a timing chart showing an operation of the X-selecting signal generating unit and a tone signal generating unit according to the first embodiment of the present invention.

Then, the description will be oriented to the arrangement and the operation of the X-selecting signal generating unit and the tone signal generating unit 1204. The block 1204 is composed of an X address decoder 1801, a selection signal selector 1802, and a data signal selector 1803 as shown in FIG. 18, in which the input signals are an X address, an enable, display data, and sweep voltages SB, SB+β, SB+2β and SB+3β and the input voltages are the selection on voltage VG and the GND. At first, as shown in FIG. 20, the Y address decoder 1801 outputs the AX signal for making the line specified by the X address signal "high" if the enable signal is "high". Then, the selection signal selector 1802 changes the voltage level of the line to which the "high" AX signal is outputted into the selection on voltage VG and changes the voltage levels of the other lines into the GND, and output it as the X-selecting signal. On the other hand, the data signal selector 1803 selects one of the voltage levels SB, SB+β, SB+2β and SB+3β according to the value of the display data, for the line to which the "high" AX signal is outputted, changes the voltage level of the other lines to the GND, and then output the result as the tone signal D. In addition, the selecting relation between the display data and the tone signal D is equal to the relation between the tone data and the tone signal D shown in FIG. 7. FIG. 20 shows the inputs of an address and an enable for realizing the operations of the X-selecting signals X0 to X2 and the tone signals D0 to D2 that have been shown in FIG. 11. The X addresses 00h, 01h and 02h indicate the addresses for selecting the X-selecting signals X0, X1 and X2, respectively.

The foregoing operation allows the liquid crystal module 1201 to provide the target pixel equipped with a memory function with the desired display luminance by inputting the address, the enable signal, and the display data.

Figure 21:
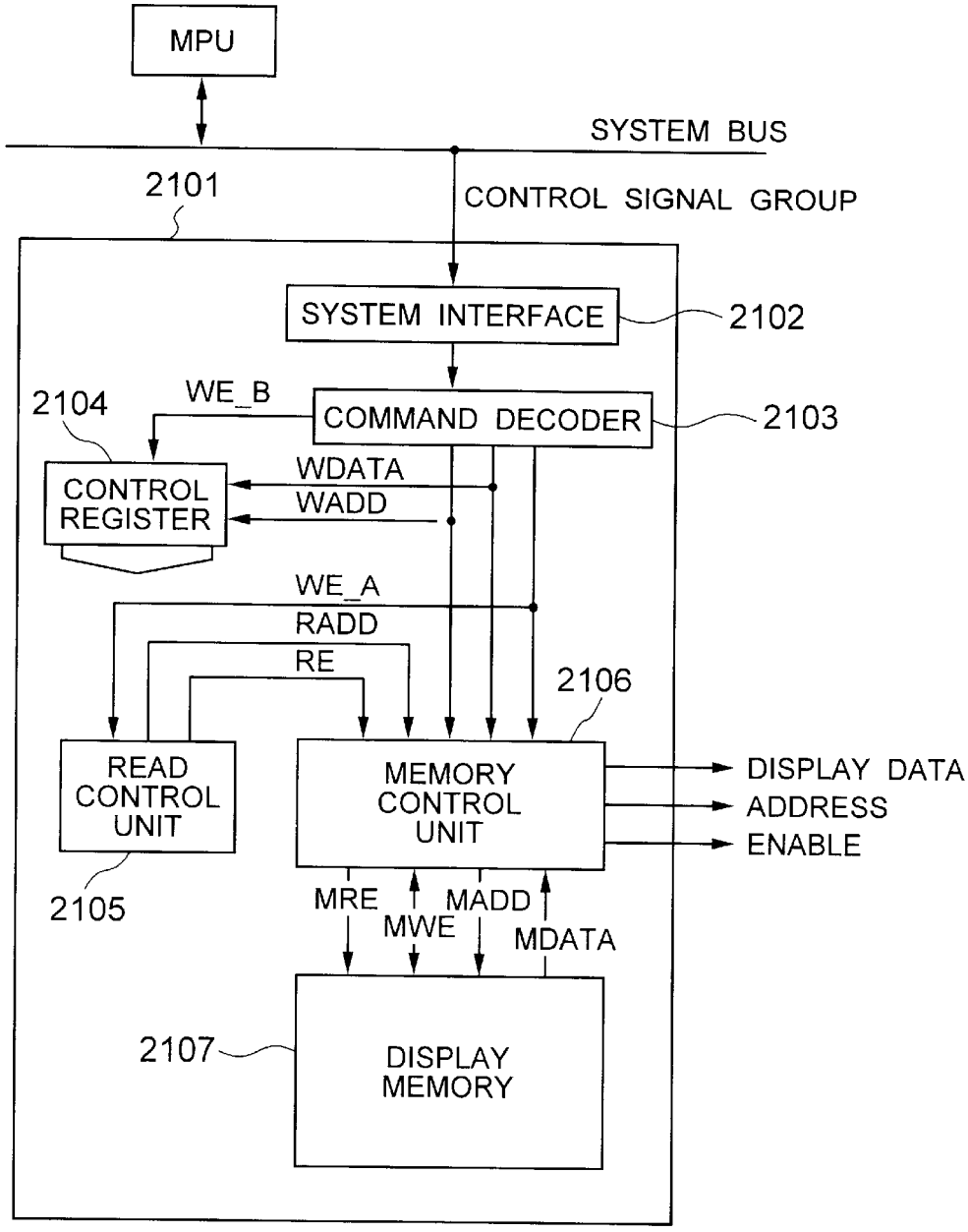
FIG. 21 is a block diagram showing an arrangement of a liquid crystal controller according to the first embodiment of the present invention.

Then, the address, the enable signal and the display data are generated and then outputted to the liquid crystal module 1201. The arrangement and the operation of the liquid crystal controller will be described with reference to FIGS. 21 to 26. FIG. 21 is a block diagram showing an arrangement of the liquid crystal controller 2101, in which a numeral 2102 denotes a system interface, a numeral 2103 denotes a command decoder, a numeral 2104 denotes a control register, a numeral 2105 denotes a read control unit, a numeral 2106 denotes a memory control unit, and a numeral 2107 denotes a display memory. The group of control signals to be inputted to the liquid crystal controller 2101 are supplied from the system bus of the overall device provided with the liquid crystal. The rewrite of the display data is controlled by the MPU. When the rewrite instruction is executed, the information of the rewritten portion (address and data) is transferred from the system bus to the liquid crystal controller. The format on which the group of control signals supplied from the system bus is transferred complies with the so-called 68 system MPU bus interface. That is, the liquid crystal controller 2101 receives the information containing the changed display data from the MPU. More specifically, if the current frame is different in tone from the previous frame, the MPU transfers the display data for representing the tone to the liquid crystal controller 2101 but does not transfer the display data to the pixels whose tones are not changed. The liquid crystal display device according to the invention does not need to apply the tone voltage onto all the pixels at each frame with respect to a still picture and a motion picture with little motion and thereby lowers the power consumption, because the memory circuit (capacitance 102) located at each pixel enables to keep the voltage level corresponding to the tone signal during the period when no tone change takes place on each pixel (except the refreshing operation).

Figures 22, 23:
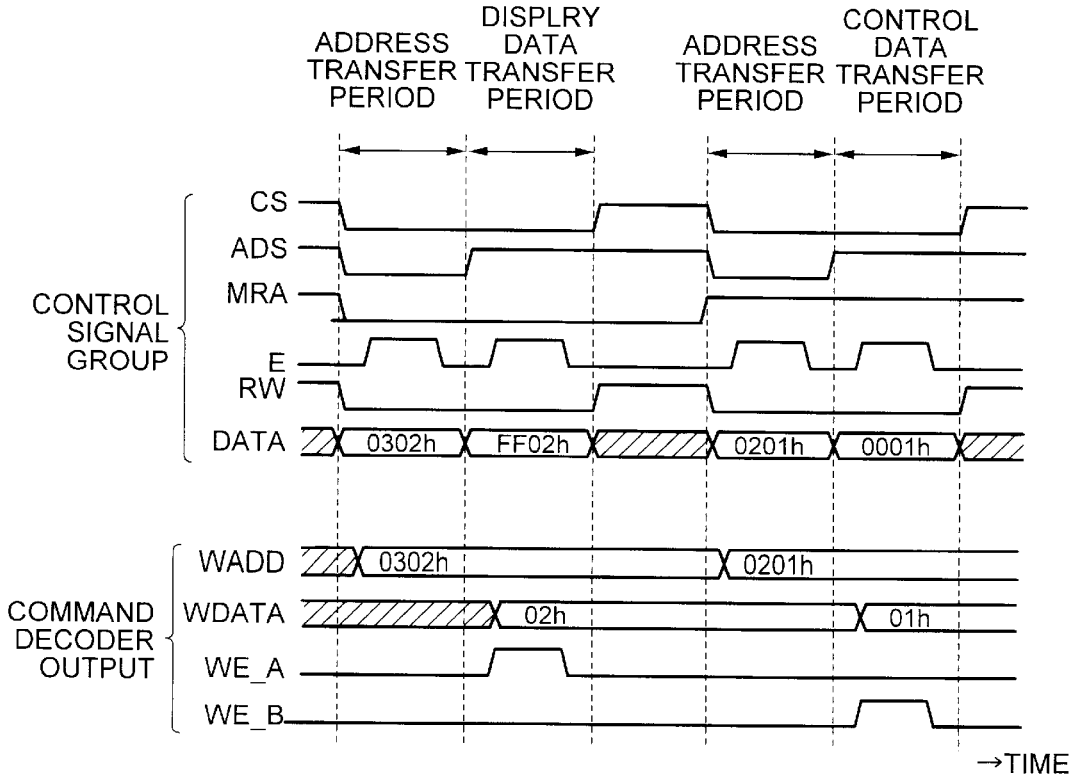
FIG. 22 is a table showing a group of control signals according to the first embodiment of the present invention.
FIG. 23 is a timing chart showing an operation of a command decoder according to the first embodiment of the present invention.

FIG. 22 shows six control signals CS, ADS, MRS, E, RW and DATA, each of which has the meaning shown in FIG. 22. Those signals are inputted into the command decoder 2103 through the system interface 2102.

The command decoder 2103 operates to determine if the inputted DATA is register data, display data or one of their addresses on the basis of the information on the inputted group of control signals. As shown in FIG. 23, the WADD signal that is a write address, the WDATA signal that is write data, the WE_A signal that is a write enable for a memory, a WE_B signal that is a write enable for a register are all outputted in synchronous to the "high" level of the E signal. If the WADD signal indicates an address of the display data, the upper 8 bits of 16 bits indicate the Y address and the lower 8 bits thereof indicate the X address.

The control register 2104 receives the WADD signal, the WDATA signal, and the WE_B signal of the foregoing signals and then stores the data of the WDATA signal in the address specified in the WADD signal in synchronous to the "high" level of the WE_B signal. In addition, the stored register data is a group of signals for controlling the liquid crystal controller 2102, the description of which is left out here.

Then, the read control unit 2105 is a block for controlling the reading operation of the display memory 2107. The block 2105 generates the read address RADD signal and the read enable RE signal and then outputs these signals. Specifically, for example, as shown in FIG. 24, during the display readout period, the RADD signal is incremented from 0000h in sequence. During the incrementing period, the RE signal is changed into the "high" level. Then, if all the addresses of the display data of one screen are specified, the increment is stopped and then the RE signal is changed into the "low" level. The series of operations are intermittently repeated. Even during the display data readout period, if the WE_A signal that is a write enable is at the "high" level, the address increment is stopped and then the RE signal is changed into the "low" level. Further, the upper 8 bits of the 16-bit RADD signal indicates the Y address and the lower 8 bits indicates the X address.

Next, the memory control unit 2106 is a block for controlling the write and read of the display memory 2107. As shown in FIG. 25, the memory control unit 2106 selects the address, the data and the enable signals for the write when the WE_A signal is at the "high" level or the same signals for the read when the WE_A signal is at the "low" level. Then, the memory control unit 2106 outputs those signals as the MADD signal, the MDATA signal, the MRE signal, and the MWE signal to the display memory 2107. Apart from this, the address, the display data and the enable signal are outputted as the display data, the address and the enable signal to the liquid crystal module 1201. Herein, the display data has multi-bit tone information to be transferred from the system bus by the instruction of the MPU. In the liquid crystal module 1201, the display data is applied onto the Dn line at the voltage level corresponding to the tone information. The modeled form of the output timing of the enable signal and the display data is shown in FIG. 26. During a certain period, the display data for one screen is intermittently outputted. The display data having a portion to be rewritten is outputted at any time irrespective of that period. The reason why the display data for one screen is intermittently outputted during a certain period is for recharging the charges in consideration of the leakage of the charges condensed in the capacitor 102 inside of the pixel 101. This period is derived as follows. At first, when the voltage drop of the memory signal SM caused by the leakage is ($\beta/2$) or more, the tone is erroneously recognized as the neighboring tone and the pulse signal SP for the neighboring tone is generated. Hence, before the voltage drop of the memory signal SM is ($\beta/2$), it is necessary to transfer the display data and do the recharging operation. Stating the concrete numeric values, in a case that ($\beta/2$) is 1V, the capacitor 102 is 1 pF, and the leak current is 0.1 pA, the charge time of the ($\beta/2$) voltage extends for 10 seconds. It means that the display data is to be transferred at this period. This is 60 times as long as the transfer period of the prior art, that is, (1/60) second.

The foregoing arrangement and operation of the liquid crystal controller 2101 make it possible to generate the input signal of the liquid crystal module 1201 from the group of control signals supplied from the system bus.

As described above, the liquid crystal module 1201 according to the first embodiment of the invention does not need to change the Y-selecting signal, the X-selecting signal and the tone signal D for a time when the memory circuit provided in the pixel holds the data if a still picture is displayed, for example. Further, the alternating may be realized in asynchronous to the input of the display data. On the other hand, the liquid crystal 2101 according to the first embodiment of the invention does not need to output the display data for a time when the memory circuit provided in the pixel holds the data if a still picture is displayed, for example. Hence, the liquid crystal controller 2101 is effective in reducing the power consumption more than the prior art.

Further, the liquid crystal module 1201 according to the first embodiment of the invention includes a memory function in the pixel. Further, the liquid crystal module 1201 enables to reduce the number of the wire for conveying the display data, one wire per one pixel even if the amount of tone information contained in the display data is increased. This makes it possible to simplify the circuit arrangement. Hence, this liquid crystal display device may be manufactured at a low cost.

Figures 27, 28:
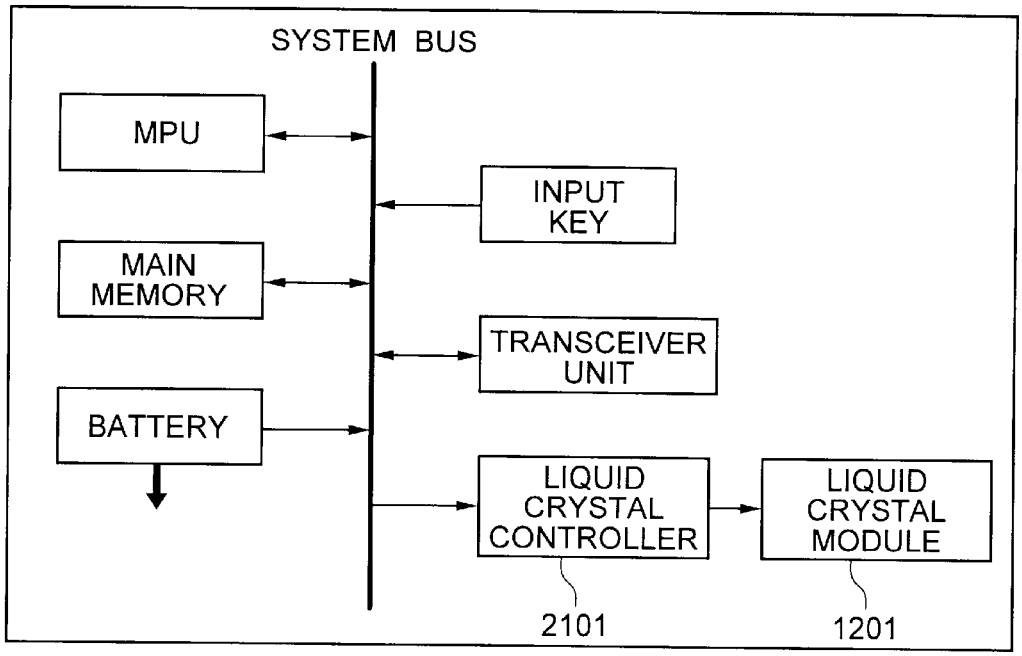
FIG. 27 is a block diagram showing a system arrangement of a portable phone according to the first embodiment of the present invention.
FIG. 28 is a table showing relation between tone data and a voltage-applying time according to the first embodiment of the present invention.

An example of a system having the liquid crystal module 1201 and the liquid crystal controller 2101 according to the first embodiment of the invention is illustrated in FIG. 27. This is a block arrangement of a portable phone. As shown in FIG. 27, all the peripheral devices are connected to the system bus and are all controlled by the MPU.

In turn, the description will be oriented to the second embodiment of the present invention with reference to FIGS. 28 to 31. In the first embodiment of the invention, a voltage of an amplitude a is applied for a time corresponding to the tone data of the alternating period T. The voltage applying time can be obtained by a square of [tone data/(tone number-1)]. Based on this expression, the voltage applying time of each tone data in the tone numbers 8 and 16 is obtained. The result is listed in FIG. 28. In the first embodiment of the invention, therefore, the voltage applying time in the portion having a small value of the tone data (for example, tone data 1) is abruptly reduced with increase of the tones in number because the alternating period T is divided by the square of (tone number-1).

On the contrary, the second embodiment of the invention concerns with the method of evenly dividing the alternating period T by (tone number-1) and applying the voltage to the liquid crystal for a time corresponding to the tone data.

Figure 29:
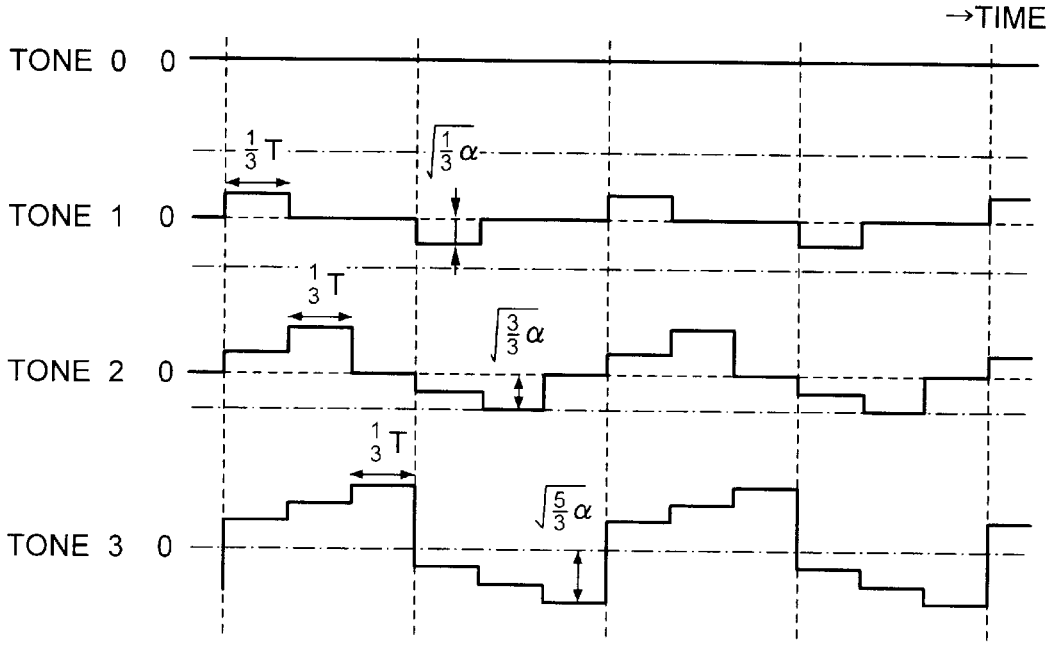
FIG. 29 is a timing chart showing a voltage waveform to be applied onto the liquid crystal according to a second embodiment of the present invention.

At first, in the case of evenly dividing the alternating period T by (tone number-1), the effective value of the voltage applied onto the liquid crystal at each tone is exponentially changed with the amplitude fixed at a value of $\alpha$. Hence, the linearity of the tone data and the effective value applied onto the liquid crystal (display luminance) is damaged, so that the desired display luminance cannot be obtained. To overcome this shortcoming, without fixing the amplitude at the value of a, it is considered that the amplitude is changed at each of the divided time portions. For example, as shown in FIG. 29, by combining the voltage waveform where the amplitude is increased by $\sqrt{(2/3)}\times\alpha$ at each divided time portion with the pulse width control, it is possible to make the alternating pulse waveform shown in FIG. 3 equivalent to the effective value of the voltage applied onto the liquid crystal at each tone. In general, in the case of dividing the alternating period T by (tone number-1), the linearity of the tone data and the display luminance can be obtained by increasing the amplitude of the pulse signal by $\sqrt{[2/(\text{tone number-1}]\times\alpha}$ at each of the divided period portions.

Figure 30:
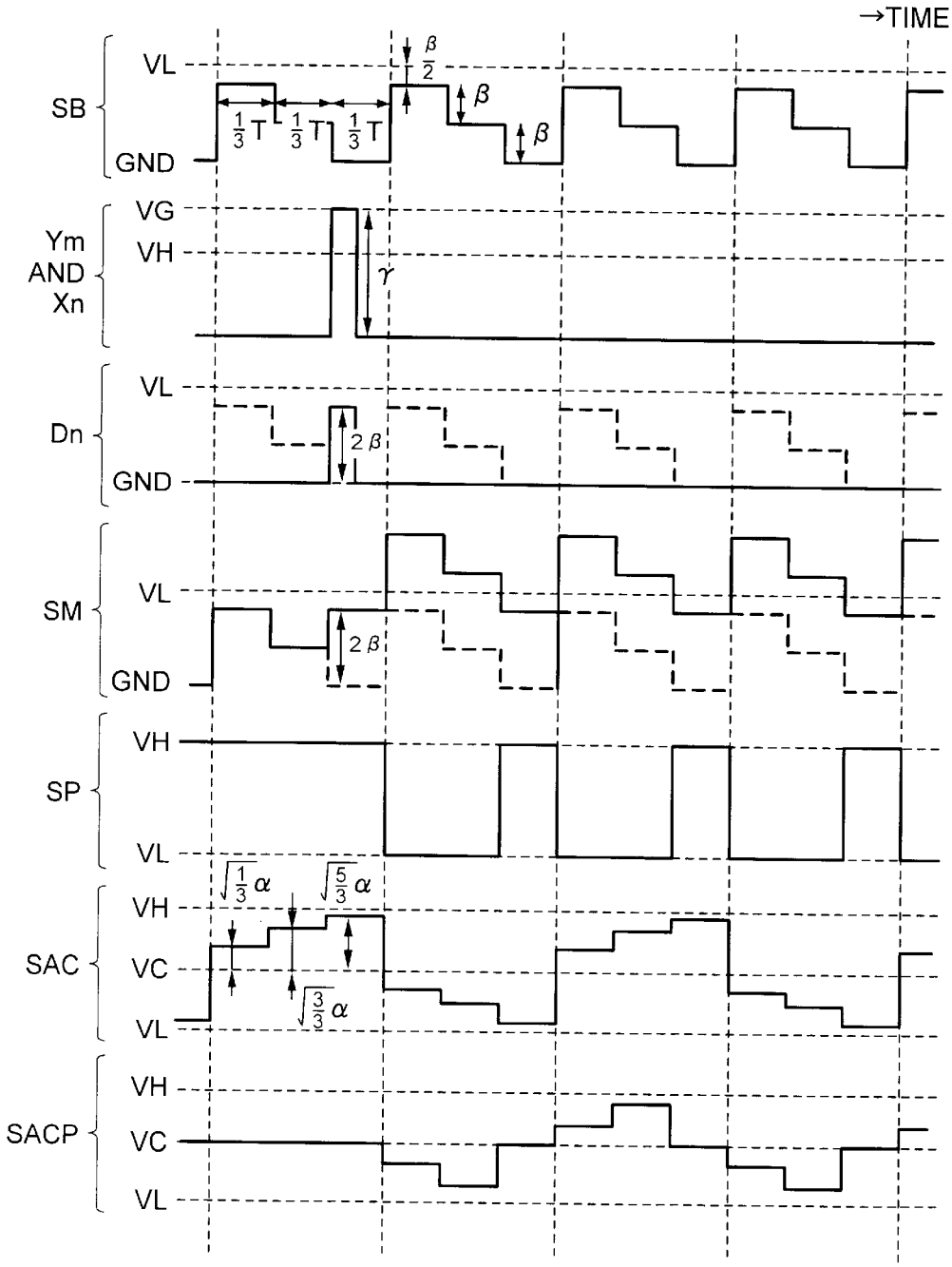
FIG. 30 is a timing chart showing an operation of a pixel according to the second embodiment of the present invention.

In order to realize this operation, for example, as shown in FIG. 30, the sweep signal SB is transformed into a stepwise waveform where the signal is changed from $2\beta$ to the GND level and the tone signal Dn is transformed into such a waveform as being generated on the sweep signal SB. Further, the alternating signal SAC may have a waveform where it is changed into the voltage level at each of the divided period portions as shown in FIG. 30. This may be easily realized by changing the circuit of the driving voltage generating unit equipped in the liquid crystal module.

According to the second embodiment of the invention as described above, the method for evenly dividing the alternating period T by (tone number-1) may offer the characteristic of the tone data against the display luminance that is equal to that of the first embodiment of the invention. Hence, the second embodiment may extend the time of applying the voltage onto the liquid crystal in the portion having a small tone data value (for example, tone data 1) more than the first embodiment of the invention.

Figure 31:
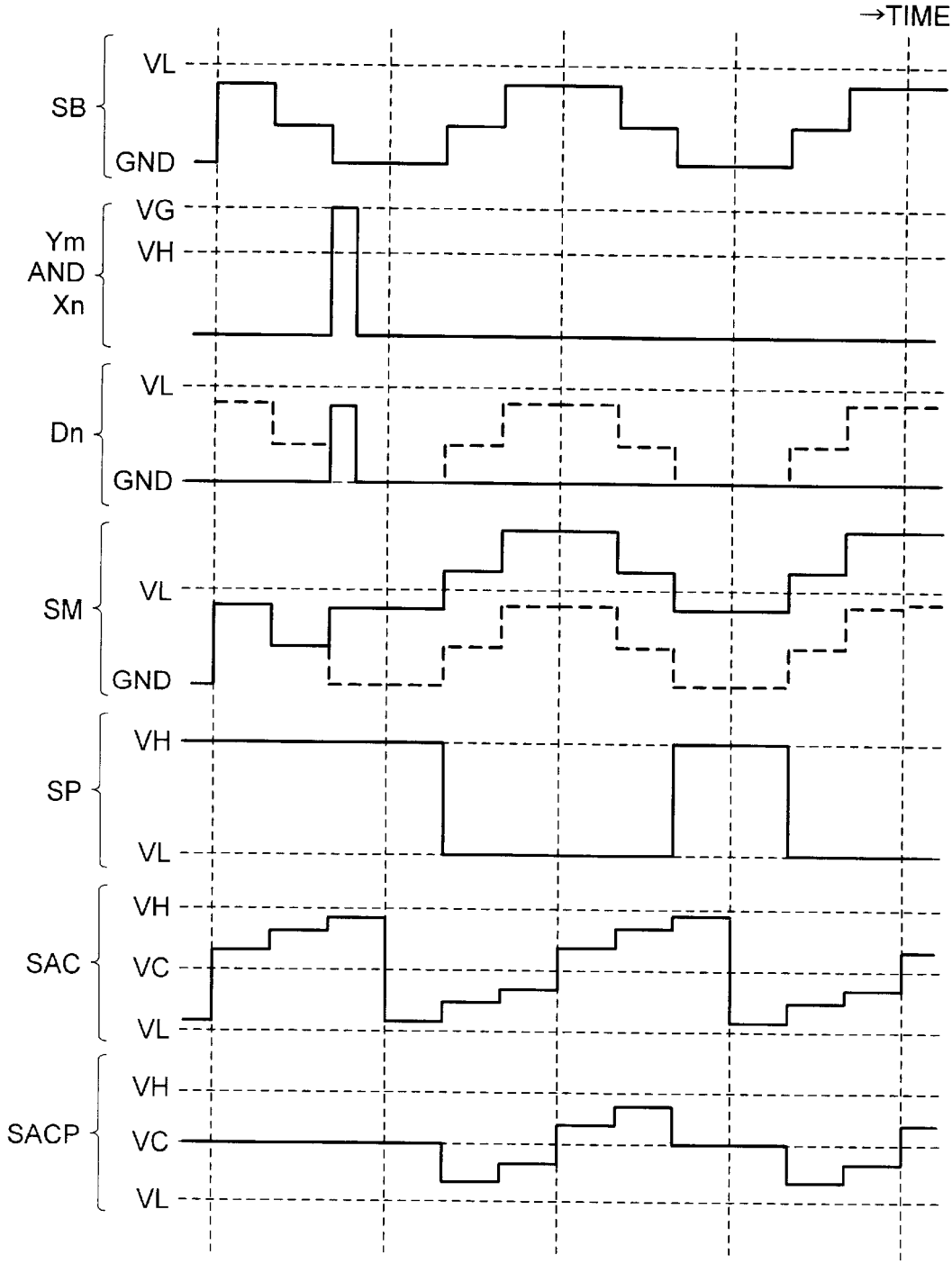
FIG. 31 is a timing chart showing an operation of the pixel according to the second embodiment of the present invention.

Moreover, as shown in FIG. 31, by reversing the phase of the sweep signal SB at each alternating period T, it is possible to reduce the frequency of the sweep signal SB, thereby making it possible to reduce the power consumption more.

In turn, the description will be oriented to the third embodiment of the present invention with reference to FIGS. 32 to 37. The third embodiment of the invention concerns with the matrix type liquid crystal display device which has a reduced number of transistors inside of the pixel.

Figure 32:
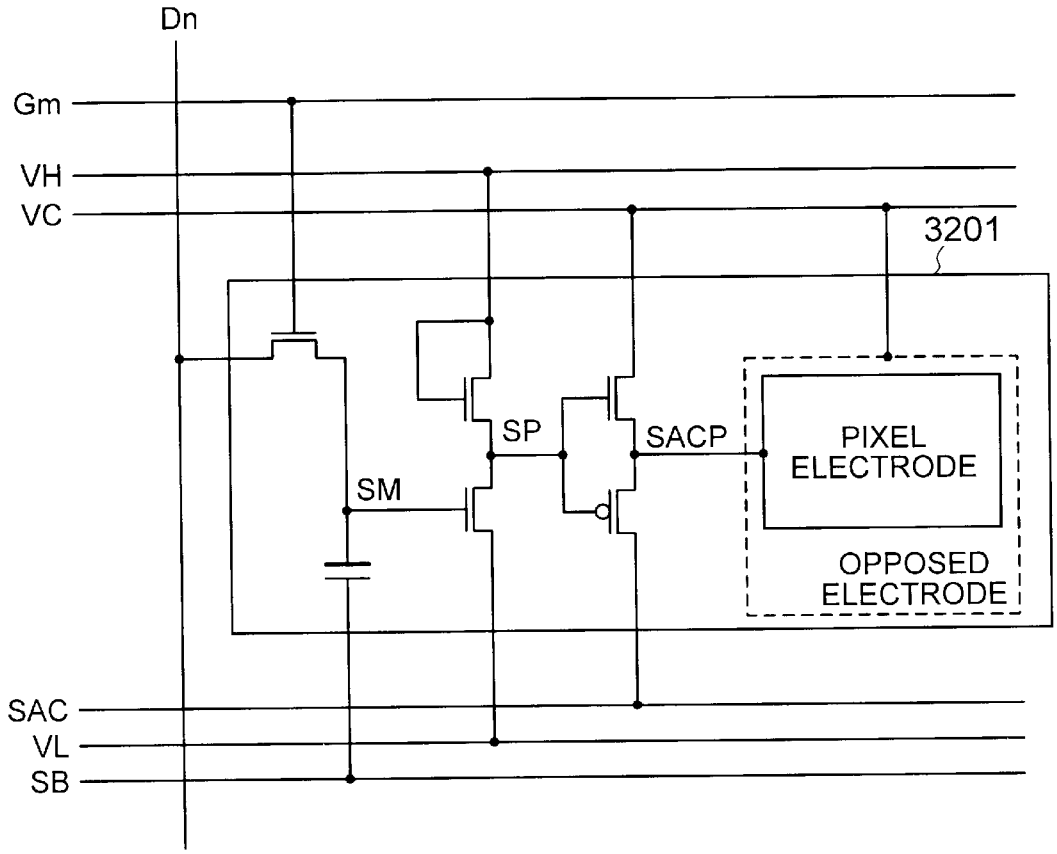
FIG. 32 is a circuit diagram showing a structure of a pixel according to a third embodiment of the present invention.
Figure 33:
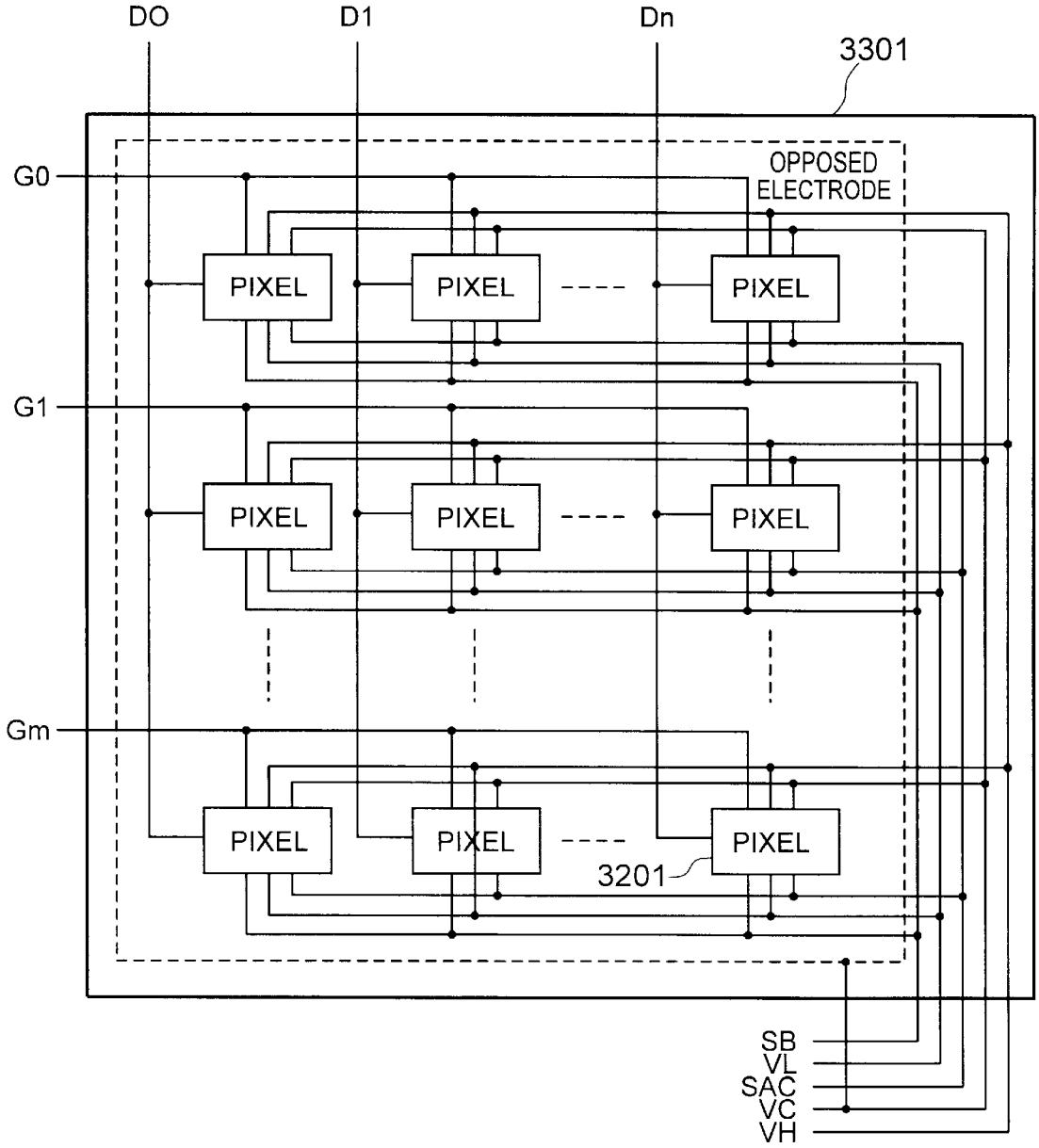
FIG. 33 is a circuit diagram showing a structure of a group of pixels according to the third embodiment of the present invention.

FIG. 32 shows a composition of a pixel located at the mth row and nth column included in the matrix type liquid crystal display device according to the third embodiment of the invention. In comparison with the pixel 101 included in the first and the second embodiments of the invention, the pixel 3201 does not include an N type MOS transistor to be controlled by the X-selecting signal. The remaining circuit elements and the input signal waveforms of the pixel 3201 are the same as those of the pixel 101. The pixel 3201 is operated in the same manner as the pixel 101. FIG. 33 shows the connection of the input signal group with the pixel group 3301 in which a plurality of pixels 3201 are located in a matrix format. In comparison with the pixel group 901 included in the first and the second embodiments of the invention, the pixel 3301 is the same as the pixel group 901 except that the X-selecting signal is removed.

As described above, the third embodiment of the invention is intended for providing each pixel with the target display luminance without having to use the X-selecting signal. If no X-selecting signal is given, the tone voltage D is applied onto all the pixels located on the line where the Y-selecting signal is changed into the selection on voltage at a time, independently of whether or not the tone information is changed.

As an example of this operation, the description will be oriented to the operation of providing four pixels with the display luminance in sequence, which has been illustrated in FIG. 10. In FIG. 10, all the pixels described as no change are provided with the display luminance corresponding to the tone 0.

Figure 34:
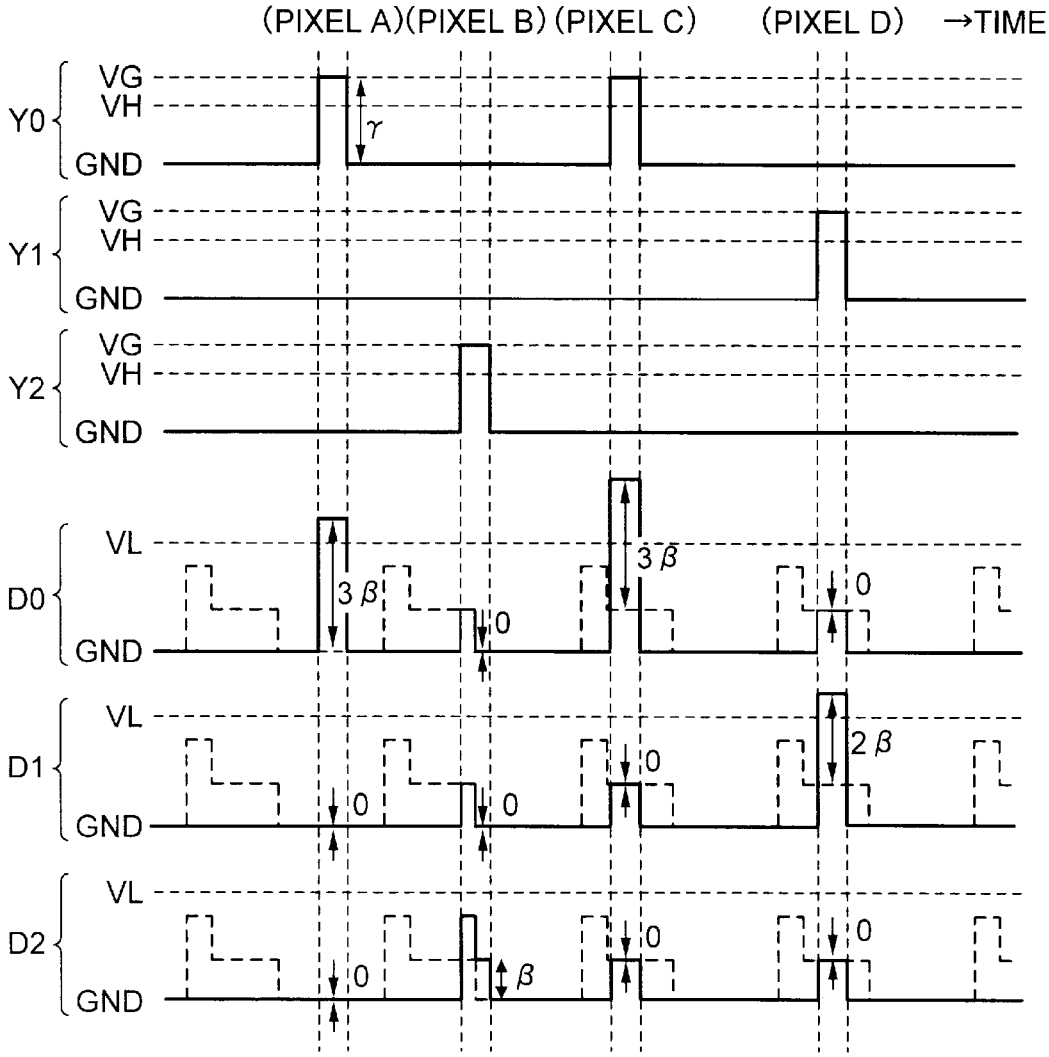
FIG. 34 is a timing chart showing an input signal of the group of pixels according to the third embodiment of the present invention.

FIG. 34 is a timing chart of the Y-selecting signals Y0 to Y2 and the tone signals D0 to D2. In FIG. 34, since the pixel A is selected, the Y-selecting signal Y0 is changed into the selection on voltage VG. At this time, on the line where Y0 is applied, the following pixels are located:

Pixel A (Intersection of Y0 and D0: Tone 3)

Pixel C (Intersection of Y0 and D1: Tone 0)

Pixel with no change (Intersection of Y0 and D2: Tone 0)

Hence, on this timing, the tone signal D0 is changed into a higher voltage level than the sweep signal SB indicated by a dotted line by 3β, and the tone signals D1 and D2 are changed into the same voltage level as the sweep signal SB. Then, since the pixel B is selected, Y2 is changed into the selection on voltage VG. Likewise, on this timing, D2 is changed into a higher voltage level than the sweep signal SB by β, and D0 and D1 are changed into the same voltage level as the sweep signal SB. Likewise, since the pixel C is selected, Y0 is changed into the selection on voltage VG. On this timing, D0 is changed into a higher voltage level than the sweep signal SB by 3β, and D1 and D2 are changed into the same voltage level as the sweep signal SB. Lastly, since the pixel D is selected, Y1 is changed into the selection on voltage VG. On this timing, D1 is changed into a higher voltage level than the sweep signal SB by 2β, and D0 and D2 are changed into the same voltage level as the sweep signal SB.

The foregoing operation makes it possible to write the signal level corresponding to the desired tone information on the pixels A to D individually and then convert the signals into the ac pulse signal SACP of the time width corresponding to the tone information described before. This thus makes it possible to provide the target pixel in the pixel group 3301 with the target display luminance.

Figure 35:
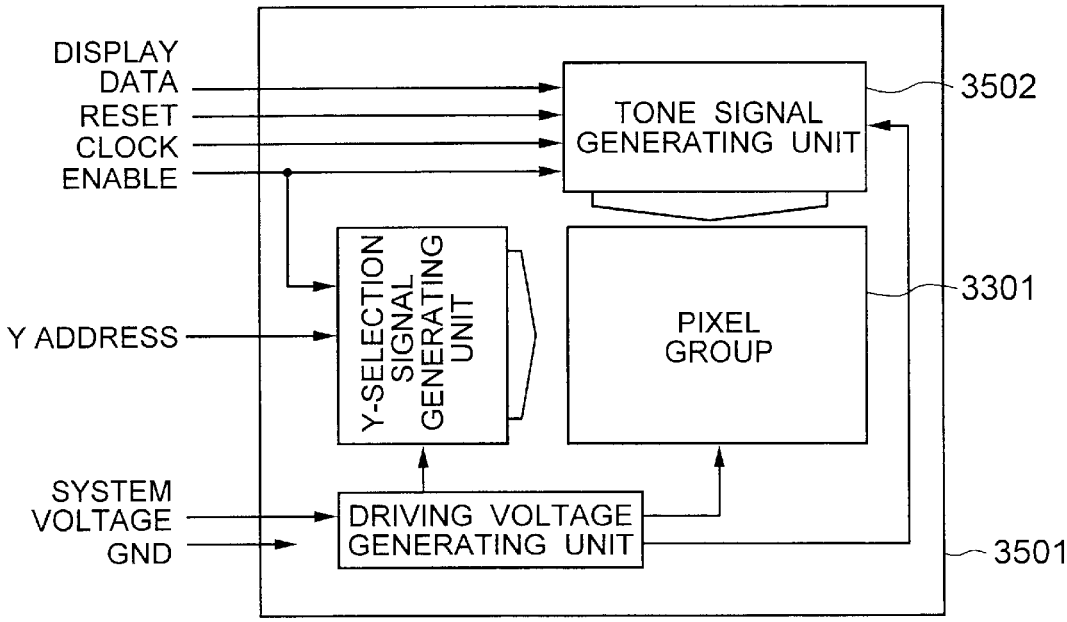
FIG. 35 is a block diagram showing an arrangement of a liquid crystal module according to the third embodiment of the present invention.
Figure 36:
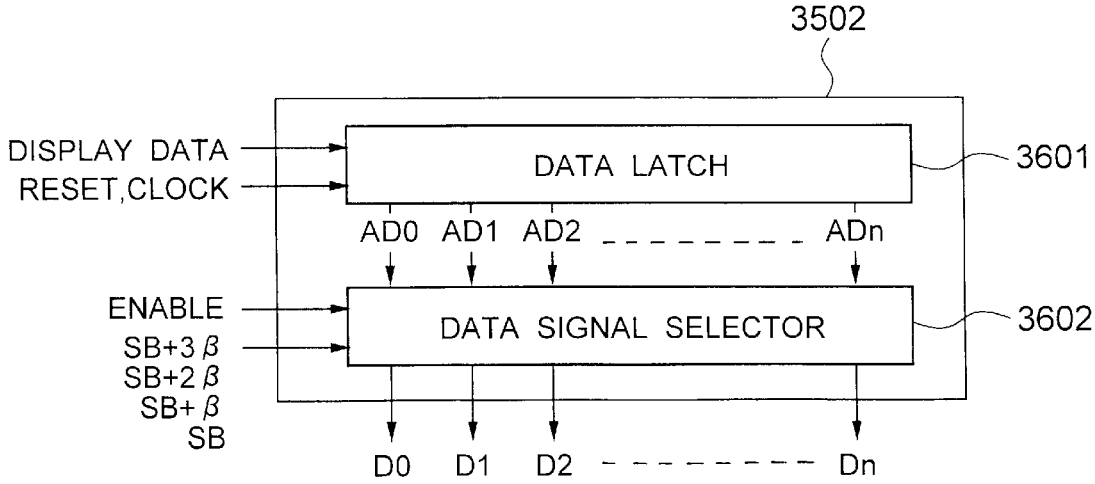
FIG. 36 is a block diagram showing an arrangement of a tone signal generating unit according to the third embodiment of the present invention.
Figure 37:
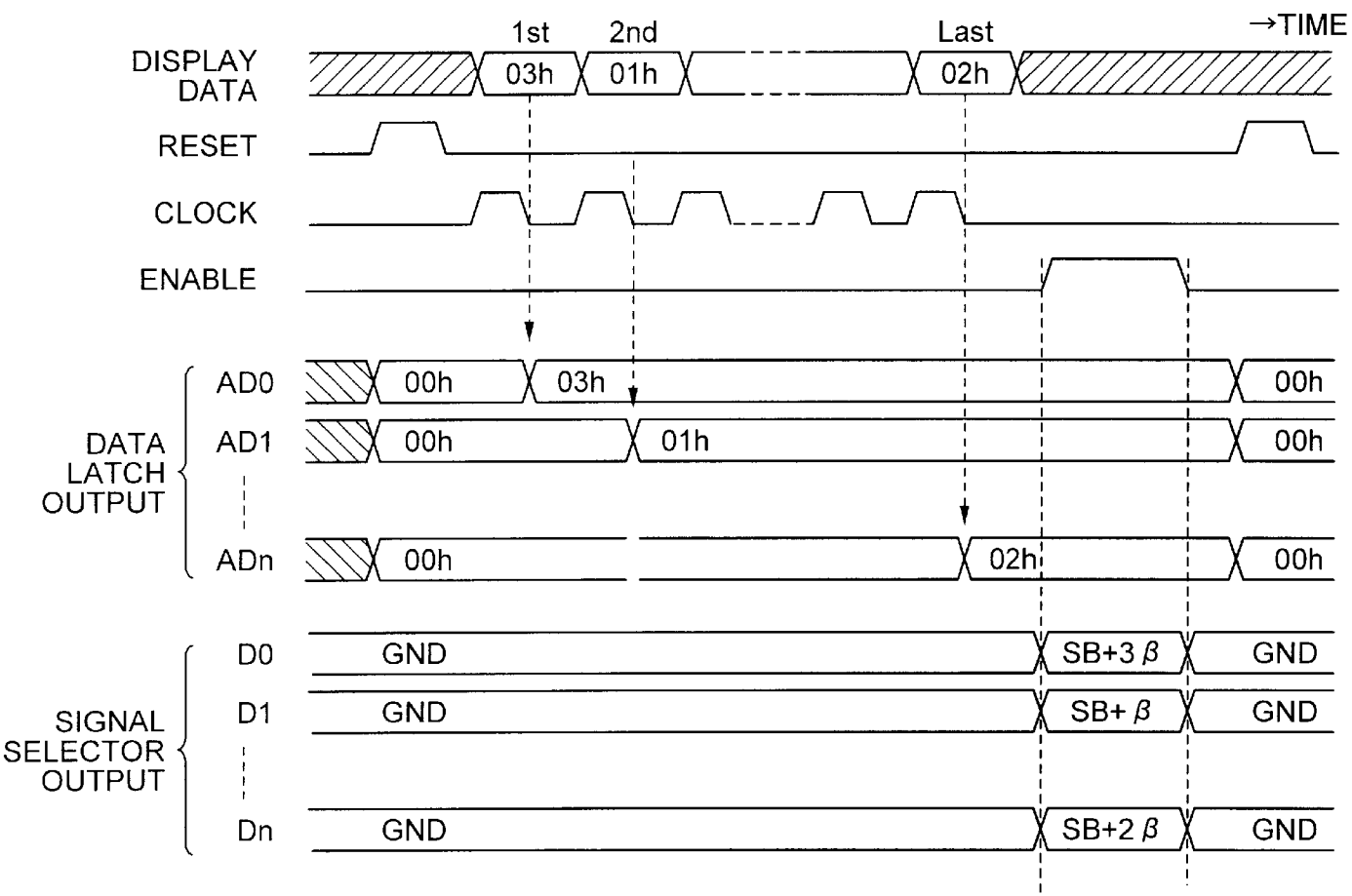
FIG. 37 is a timing chart showing an operation of a tone signal generating unit according to the third embodiment of the present invention.

Then, the description will be oriented to the arrangement and the operation of the liquid crystal module provided with a driving circuit for generating the group of input signals with reference to FIGS. 35 to 37. FIG. 35 is a block diagram showing an arrangement of a liquid crystal module 3501, which is the same as that of the liquid crystal module 1201 according to the first and the second embodiments of the invention except a tone signal generating unit 3502. Further, the module 3501 is operated in the same manner as the module 1201. The group of signals to be inputted into the liquid crystal module 3501 includes display data, a reset signal, a clock signal, an enable signal, a Y address signal, a system voltage, and the GND. Later, the arrangement and the operation of the tone signal generating unit 3502 will be described.

As shown in FIG. 36, the tone signal generating unit 3502 is composed of a data latch 3601 and a data signal selector 3602. It is inputted with display data, a reset signal, a clock signal, an enable signal, and sweep voltages SB, SB+β, SB+2β and SB+3β. At first, as shown in FIG. 37, the data latch 3601 is initialized in synchronous to the reset "high". Then, the data clutch 3601 reads the display data in sequence in synchronous to the rise of the clock and then outputs the display data as ADO to ADn. The data signal selector 3602 selects one of the voltage levels SB, SB+β, SB+2β and SB+3β according to the value of the display data AD while the enable is "high" or output the GND as the tone signal D while it is "low". The relation between the display data and the selected tone signal D is equal to that between the tone data and the tone signal D shown in FIG. 7. As described above, the tone signal generating unit 3502 temporarily reads the display data of all pixels on the line selected by the Y address, synchronizes itself with the enable signal, convert the display data into the tone signal D, and then output the converted tone signal D.

The liquid crystal controller arranged to generate the display data, the reset signal, the clock signal, the enable signal and the Y address and output them to the liquid crystal module 3501 may be realized on the basis of the arrangement and the operation of the liquid crystal controller 2101 according to the first and the second embodiments of the invention shown in FIG. 21 with a slight modulation thereof. Hence, the details thereof are not described here. In essence, the liquid crystal controller is operated to write the display data inputted from the system bus onto the display memory, sequentially read the display data on the line, and then output it with the synchronous clock. With respect to the reset and the enable, as shown in FIG. 37, before and after the display data of one line is outputted, the "high" signals should be outputted.

As set forth above, the liquid crystal display device according to the third embodiment of the invention is effective in suppressing the power consumption in comparison with the prior art and may lower its manufacturing cost because the number of the transistors inside of the pixel may be reduced. It goes without saying that the signal waveform of the second embodiment may be applied to the liquid crystal display device according to the third embodiment, which may result in offering the same effect as the foregoing one.

The embodiments of the invention have been described with the four-tone display as an example. In actual, the display is not limited to this. In order to display more tones, what is required is to divide the alternating period T into more portions and fine the steps of the sweep signal SB accordingly. In these embodiments, the sweep signal has a stepwise waveform. In actual, however, it is not limited to this type of waveform.

Further, it is preferable to form the group of pixels of the invention with a polysilicon TFT element. This makes it possible to manufacture the high-performance liquid crystal device at a low cost. Further, the liquid crystal module including a peripheral devices such as a signal generating unit and a driving voltage generating unit may be integrally formed with the polysilicon TFT element. This makes it possible to lower the manufacturing cost more.

According to the embodiment of the invention, for example, in the case of displaying a still picture, it is not necessary to change the Y-selecting signal, the X-selecting signal, and the tone signal D during the time when the memory circuit provided inside of the pixel is holding the data. Further, the alternating can be realized in asynchronous to the input of the display data. On the other hand, the liquid crystal controller is not required to output the display data during the time when the memory circuit provided inside of the pixel holds the data. Hence, it is effective in reducing the power consumption more than the prior art.

Even if the tone information amount contained in the display data is increased, the number of wires for conveying the display data for one pixel may be reduced one wire for one pixel, which prevents the circuit from being complicated and lowers the manufacturing cost of the liquid crystal display device.

What is claimed is:

1. A liquid crystal display device for displaying data, comprising:

a liquid crystal panel having a plurality of pixels located in a matrix format;

a Y-selecting signal generating unit for selecting pixel rows of said plurality of pixels;

an X-selecting signal generating unit for selecting pixel columns of said plurality of pixels; and a tone signal generating unit for generating a tone signal for applying a tone voltage corresponding to tone information of said display data onto each of said plurality of pixels, wherein said liquid crystal panel further includes a memory circuit provided for each of said pixels to hold said tone signal according to a change of said tone signal, a pulse width converting circuit for converting a tone signal from said memory circuit into a pulse width signal, a switch circuit for selecting a voltage applied onto the liquid crystal corresponding to said pulse width signal from a plurality of voltages applied onto the liquid crystal, and a pixel electrode for applying said selected voltage applied onto the liquid crystal onto the liquid crystal, and wherein said pulse width converting circuit includes an adding circuit for adding a sweep signal whose potential is changed at each predetermined time to a tone signal from said memory circuit and a switch circuit for outputting a signal having a corresponding level with a compared result between signal from said adding circuit and a predetermined value.

2. A liquid crystal display device for displaying data, comprising:

a liquid crystal panel having a pair of substrates at least one of which is transparent, a liquid crystal layer formed between a pair of substrates, and a plurality of pixels;

a Y-selecting signal generating unit for selecting one or more pixel rows of said plurality of pixels;

an X-selecting signal generating unit for selecting one or more pixel columns of said plurality of pixels;

a tone signal generating unit for generating a tone signal corresponding to the tone information of said display data and outputting said tone signal to each of said plurality of pixels;

a memory circuit for starting to hold the tone signal from said tone signal generating unit if the Y-selecting signal from said Y-selecting signal generating unit and the X-selecting signal from said X-selecting signal generating unit are changed from the non-selecting state to the selecting state;

a pulse width converting circuit for modulating the tone signal from said memory circuit in time and generating a binary pulse width signal;

a switch circuit for switching an ac signal with a center voltage signal according to the level of said binary pulse width signal; and a pixel electrode being connected to said switch circuit, wherein said pulse width converting circuit includes an adding circuit for adding a sweep signal whose potential is changed at each predetermined time to a tone signal from a said memory circuit and a switch circuit for outputting a signal having a corresponding level with a compared result between a signal from said adding circuit and a predetermined value.

3. A liquid crystal display device as claimed in claim 2, wherein said switch circuit is served to output said ac signal to said pixel electrode during the time derived by multiplying a time ta derived by dividing an alternating period T of said so signal by a square of a tone number of said display data by a square of said tone number, and the amplitude of said ac signal is constant.

4. A liquid crystal display device as claimed in claim 2, wherein said switch is served to output said so signal to said pixel electrode during the time derived by multiplying a time tb derived by dividing the alternating period T of said ac signal by a square of a tone number of said display data by said tone number, and the amplitude of said ac signal is increased by a value derived by multiplying a mat of a value derived by dividing 2 by said tone number by a reference amplitude $\alpha$ at each divided time tb.

5. A liquid crystal display device as claimed in claim 2, wherein the other one of said pair of substrates includes a common opposed electrode to the plurality of pixels, and said switch circuit is served to output said center voltage signal to said opposed electrode.

6. A method for displaying data on a liquid crystal panel, comprising the steps of:

generating a corresponding tone signal to tone information of said display data, for each of a plurality of pixels disposed on said liquid crystal panel;

holding said tone signal in a memory circuit provided for each of said plurality of pixels if any pixel located on said liquid crystal panel is changed from a non-selecting state into a selecting state;

modulating the tone signal from said memory circuit in time, for generating a binary pulse width signal; and switching an ac signal with a center voltage signal according to the level of said binary pulse width signal and then outputting said signal to a pixel electrode, wherein said step of modulating includes a substep for adding a sweep signal whose potential is changed at each predetermined time to the tone signal from said memory circuit to produce an added signal and a substep for outputting a signal having a corresponding level with a compared result between the added signal and a predetermined value.

* * * * *